US011843174B2

(12) United States Patent
Hiramatsu

(10) Patent No.: US 11,843,174 B2
(45) Date of Patent: Dec. 12, 2023

(54) ANTENNA ELEMENT, ARRAY ANTENNA, COMMUNICATION UNIT, MOBILE BODY, AND BASE STATION

(71) Applicant: KYOCERA CORPORATION, Kyoto (JP)

(72) Inventor: Nobuki Hiramatsu, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 412 days.

(21) Appl. No.: 17/290,769

(22) PCT Filed: Oct. 24, 2019

(86) PCT No.: PCT/JP2019/041788
§ 371 (c)(1),
(2) Date: May 2, 2021

(87) PCT Pub. No.: WO2020/090630
PCT Pub. Date: May 7, 2020

(65) Prior Publication Data

US 2021/0376489 A1 Dec. 2, 2021

(30) Foreign Application Priority Data

Nov. 2, 2018 (JP) ..... 2018-207430

(51) Int. Cl.
*H01Q 21/06* (2006.01)
*H01Q 21/00* (2006.01)
(Continued)

(52) U.S. Cl.
CPC ..... *H01Q 21/065* (2013.01); *H01Q 1/38* (2013.01); *H01Q 9/0421* (2013.01);
(Continued)

(58) Field of Classification Search
CPC .... H01Q 21/065; H01Q 21/0006; H01Q 1/48; H01Q 1/38; H01Q 9/0421; H01Q 9/0435; H01Q 1/246
(Continued)

(56) References Cited

U.S. PATENT DOCUMENTS 7,132,984 B2 * 11/2006 Kameda ..... H01Q 9/0407 343/700 MS
2007/0075903 A1 4/2007 Matsugatani et al.
2019/0089047 A1 * 3/2019 Hara ..... H01Q 21/22

FOREIGN PATENT DOCUMENTS

CN 1875520 A 12/2006
JP 2011109414 A 6/2011

OTHER PUBLICATIONS

Yasutaka Murakami et al., Low-Profile Design and Bandwidth Characteristics of Artificial Magnetic Conductor with Dielectric Substrate, 2015, 172-179, vol. J98-B No. 2, IEEE, Japan, 9pp.
(Continued)

*Primary Examiner* — Khai M Nguyen
(74) *Attorney, Agent, or Firm* — HAUPTMAN HAM, LLP

(57) ABSTRACT

An antenna element includes an antenna and a filter. The antenna includes a conductor part, a ground conductor, three or more first connection conductors, a first feeding line, and a second feeding line. The conductor part extends along a first plane and includes a plurality of first conductors. The ground conductor is positioned separately from the conductor part and extends along the first plane. The connection conductors extend from the ground conductor toward the conductor part. The first feeding line is electromagnetically connected to the conductor part. The second feeding line is configured to be electromagnetically connected to the conductor part at a position different from a position of the first feeding line. The filter is configured to be electrically
(Continued)

connected to at least one of the first feeding line and the second feeding line. The filter is positioned to be overlapped with the ground conductor.

15 Claims, 21 Drawing Sheets

(51) Int. Cl.
*H01Q 1/38* (2006.01)
*H01Q 9/04* (2006.01)
*H01Q 1/48* (2006.01)
*H01Q 1/24* (2006.01)

(52) U.S. Cl.
CPC ..... *H01Q 9/0435* (2013.01); *H01Q 21/0006* (2013.01); *H01Q 1/246* (2013.01); *H01Q 1/48* (2013.01)

(58) Field of Classification Search
USPC ..... 343/893
See application file for complete search history.

(56) References Cited

OTHER PUBLICATIONS

Yasutaka Murakami et al., Optimum Configuration of Reflector for Dipole Antenna with AMC Reflector, 2015, 1212-1220, vol. 98-B No. 11, IEEE, 10pp.

* cited by examiner

ANTENNA ELEMENT, ARRAY ANTENNA, COMMUNICATION UNIT, MOBILE BODY, AND BASE STATION

CROSS REFERENCE TO RELATED APPLICATIONS

This application is a National Stage of PCT international application Ser. No. PCT/JP2019/041788 filed on Oct. 24, 2019 which designates the United States, incorporated herein by reference, and which is based upon and claims the benefit of priority from Japanese Patent Application No. 2018-207430 filed on Nov. 2, 2018, the entire contents of which are incorporated herein by reference.

FIELD

The present disclosure relates to an antenna element, an array antenna, a communication unit, a mobile body, and a base station.

BACKGROUND

Electromagnetic waves radiated from an antenna are reflected by a metal conductor. The electromagnetic waves reflected by the metal conductor are phase-shifted by 180°. The reflected electromagnetic waves are synthesized with electromagnetic waves radiated from the antenna. Amplitude of the electromagnetic waves radiated from the antenna may be reduced when the electromagnetic waves radiated from the antenna are synthesized with the phase-shifted electromagnetic waves. As a result, the amplitude of the electromagnetic waves radiated from the antenna is reduced. A distance between the antenna and the metal conductor is caused to be ¼ of a wavelength λ of the radiated electromagnetic waves to reduce influence of the reflected waves.

On the other hand, there has been developed a technique of reducing influence of the reflected waves by using an artificial magnetic wall. This technique is disclosed in Non Patent Literatures 1 and 2, for example.

CITATION LIST

Patent Literature

Non Patent Literature 1: Murakami et al., "Low-attitude design and band characteristic of artificial magnetic conductor using dielectric substrate", IEICE academic journal (B), Vol. J98-B No. 2, pp. 172-179

Non Patent Literature 2: Murakami et al, "Optimum configuration of reflector for dipole antenna with AMC reflector", IEICE academic journal (B), Vol. J98-B No. 11, pp. 1212-1220

SUMMARY

An antenna element according to an embodiment of the present disclosure includes a conductor part, a ground conductor, a first predetermined number of connection conductors, a first feeding line, a second feeding line, and a filter. The conductor part extends along a first plane and includes a plurality of first conductors. The ground conductor is positioned separately from the conductor part and extends along the first plane. The first predetermined number of connection conductors extend from the ground conductor toward the conductor part. The first predetermined number being three or more. The first feeding line is electromagnetically connected to the conductor part. The second feeding line is configured to be electromagnetically connected to the conductor part at a position different from a position of the first feeding line. The filter is configured to be electrically connected to at least one of the first feeding line and the second feeding line. The filter is positioned to be overlapped with the ground conductor.

An array antenna according to an embodiment of the present disclosure includes a plurality of the above-described antenna elements and an antenna substrate. On the antenna substrate, the antenna elements are arranged.

A communication unit according to an embodiment of the present disclosure includes the above-described array antenna and a controller. The controller is configured to be connected to the filter.

A mobile body according to an embodiment of the present disclosure includes the above-described communication unit.

A base station according to an embodiment of the present disclosure includes the above-described array antenna and a controller. The controller is configured to be connected to the filter.

DESCRIPTION OF EMBODIMENTS

Figure 1:
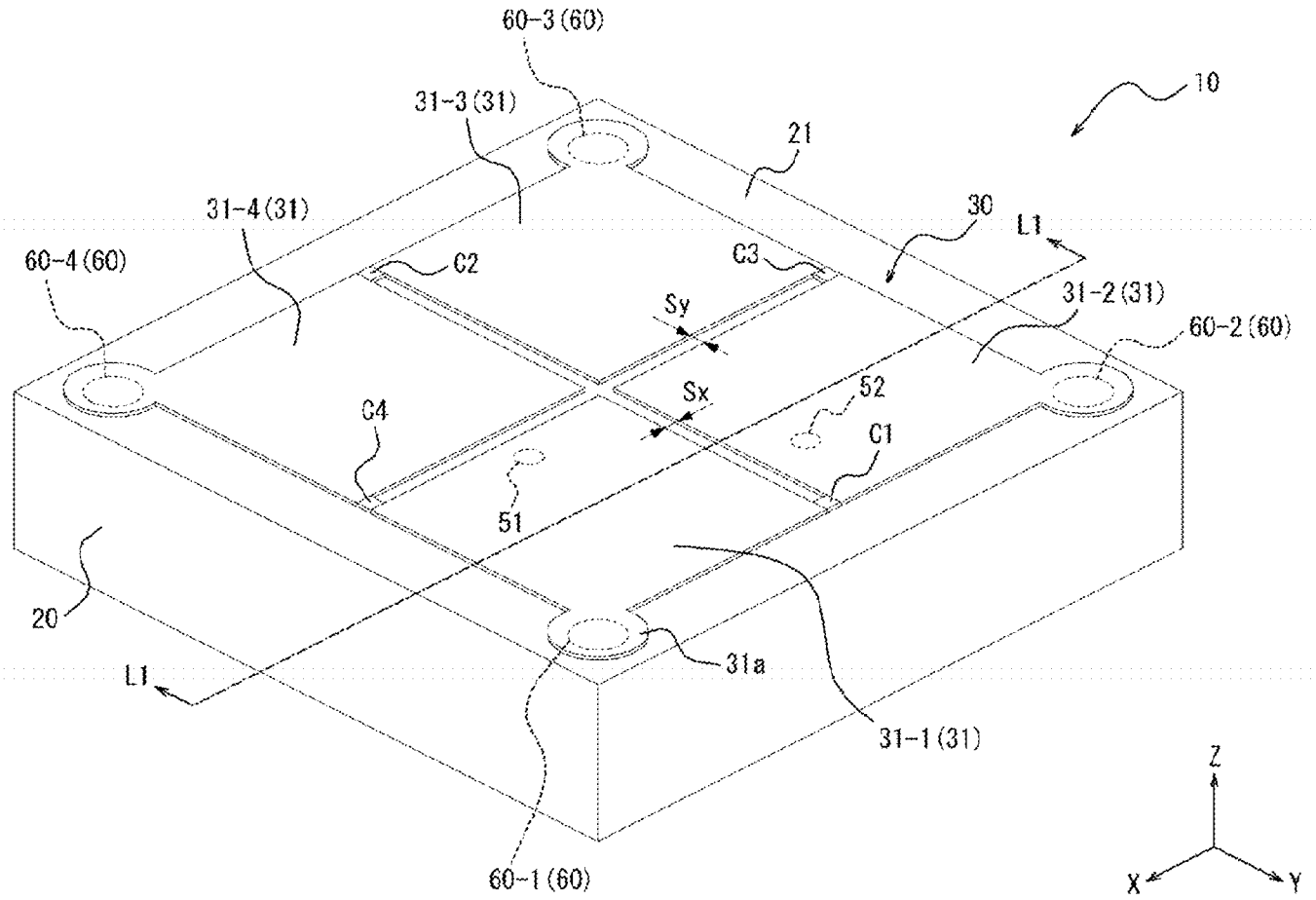
FIG. 1 is a perspective view of a resonance structure according to an embodiment.

There is room for improvement in conventional techniques.

The present disclosure relates to provision of an improved antenna element, array antenna, communication unit, mobile body, and base station.

According to an embodiment of the present disclosure, an improved antenna element, array antenna, communication unit, mobile body, and base station is provided.

In the present disclosure, a "dielectric material" may contain any of a ceramic material and a resin material as a composition. The ceramic material includes an aluminum oxide sintered body, an aluminum nitride sintered body, a mullite sintered body, a glass ceramic sintered body, a crystallized glass in which crystal components are precipitated in a glass base material, and a crystallite sintered body such as mica or aluminum titanate. The resin material includes an epoxy resin, a polyester resin, a polyimide resin, a polyamide-imide resin, a polyether-imide resin, and an uncured material such as a liquid crystal polymer that is cured.

In the present disclosure, a "conductive material" may contain any of a metallic material, an alloy of metallic material, a cured material of metal paste, and a conductive polymer as a composition. The metallic material includes copper, silver, palladium, gold, platinum, aluminum, chromium, nickel, cadmium, lead, selenium, manganese, tin, vanadium, lithium, cobalt, titanium, and the like. The alloy includes a plurality of metallic materials. A metal paste agent includes powder of metallic material kneaded with an organic solvent and binder. The binder includes an epoxy resin, a polyester resin, a polyimide resin, a polyamide-imide resin, and a polyether-imide resin. A conductive polymer includes a polythiophene polymer, a polyacetylene polymer, a polyaniline polymer, a polypyrrole polymer, and the like.

The following describes an embodiment of the present disclosure with reference to the drawings. Regarding constituent elements illustrated in FIG. 1 to FIG. 22, the same constituent elements are denoted by the same reference numeral.

Figure 2:
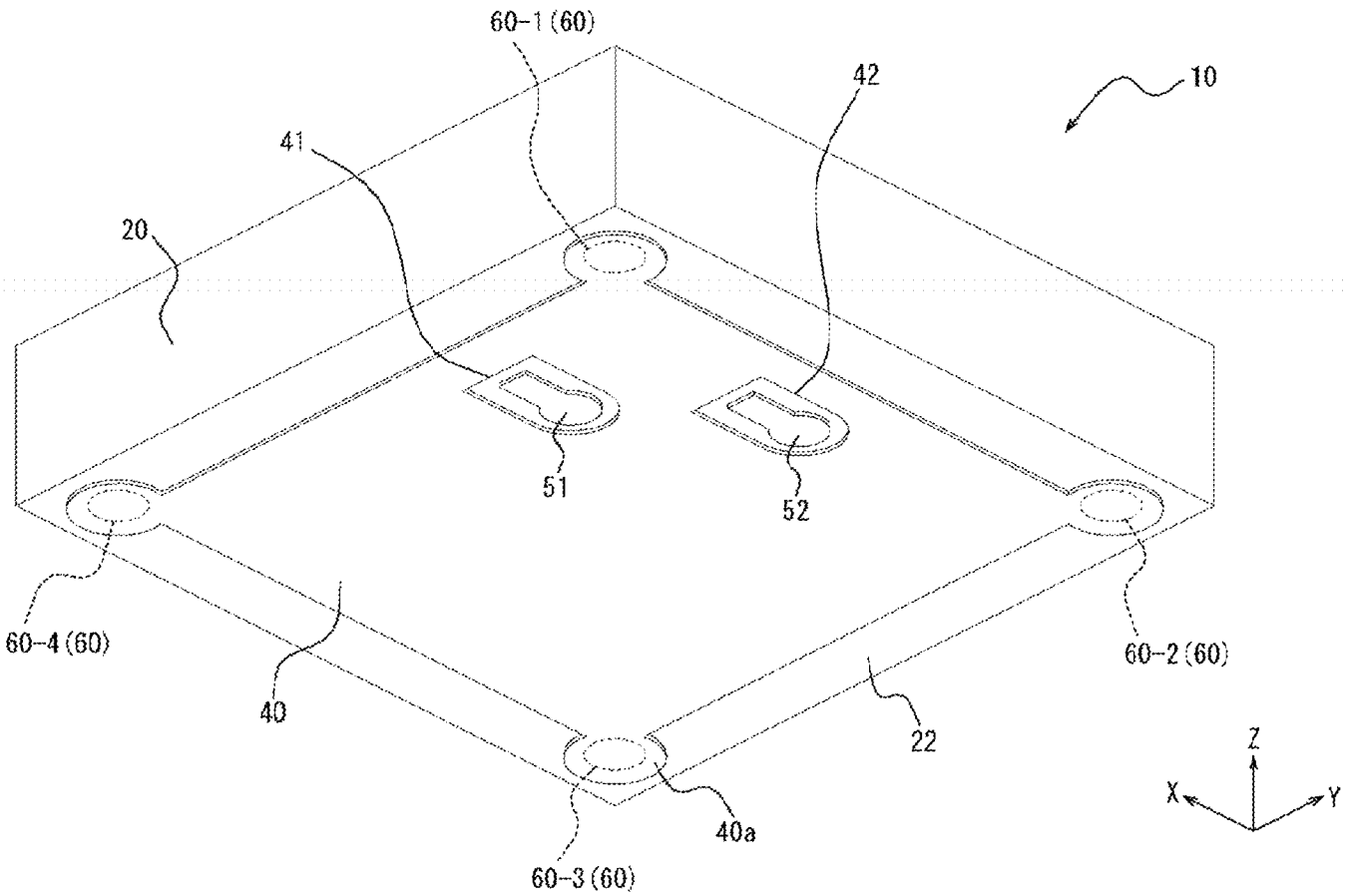
FIG. 2 is a perspective view of the resonance structure illustrated in FIG. 1 viewed from a negative direction of the Z-axis.
Figure 3:
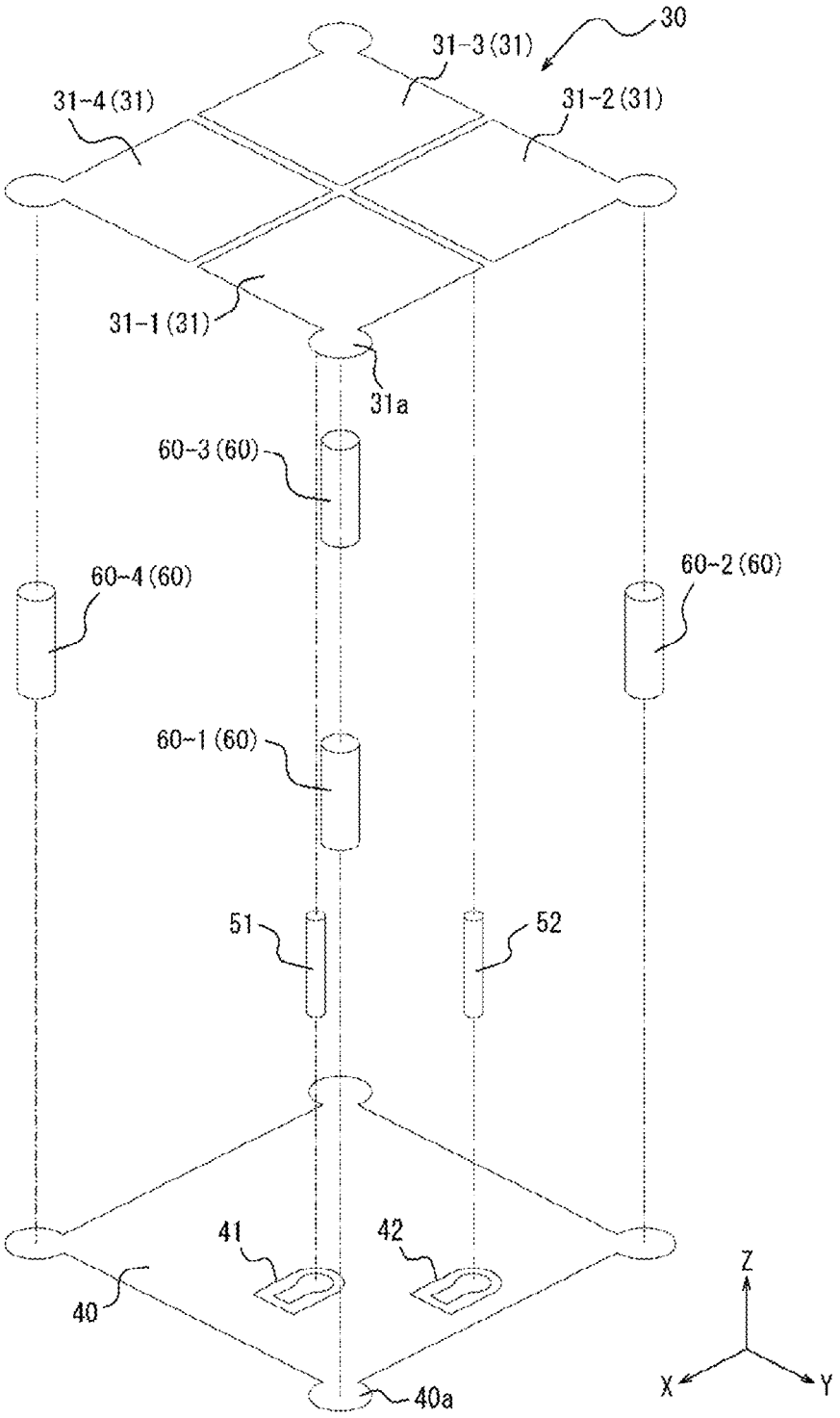
FIG. 3 is a perspective view of the resonance structure illustrated in FIG. 1 that is partially disassembled.
Figure 4:
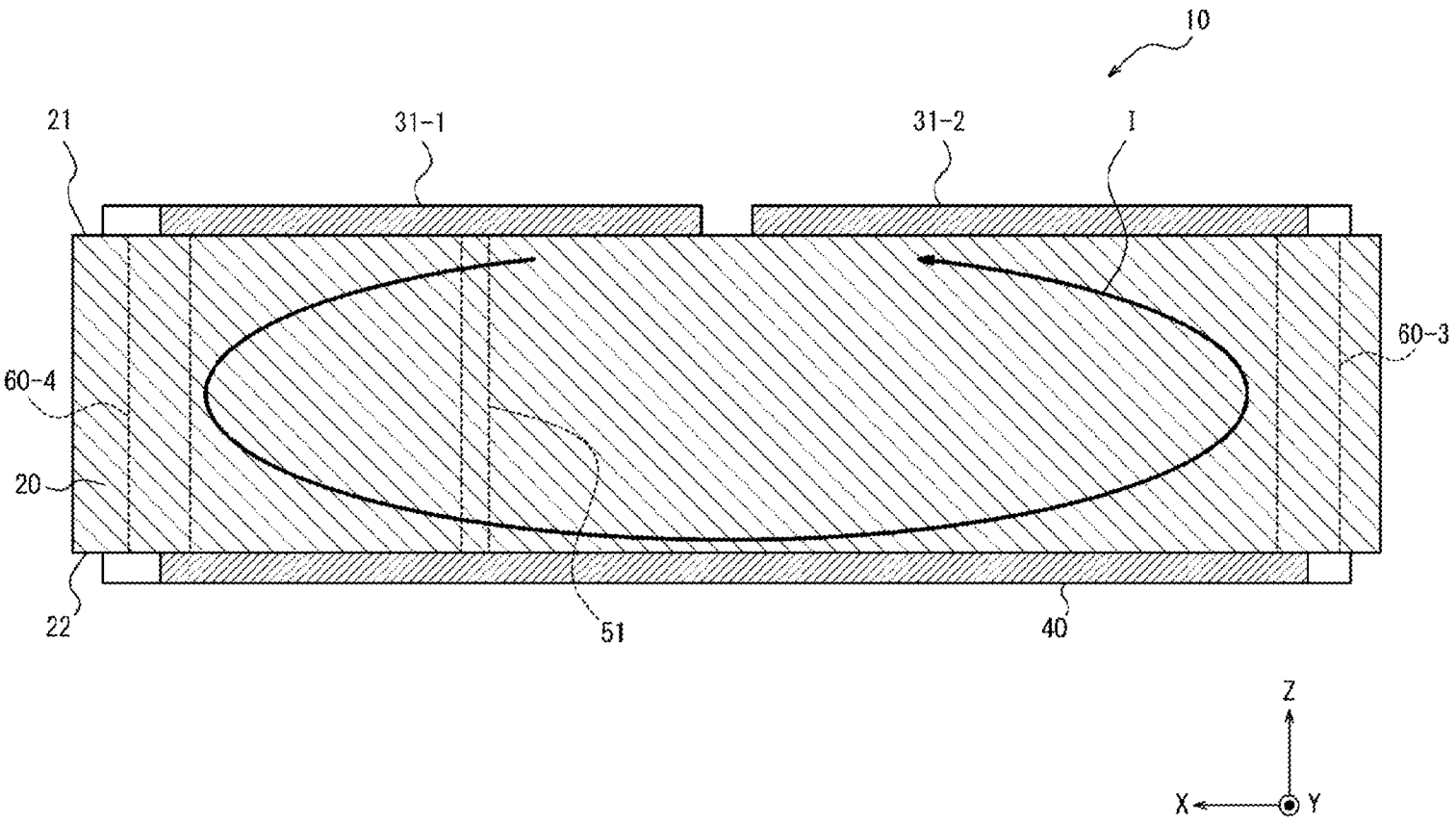
FIG. 4 is a cross-sectional view of the resonance structure along the line L1-L1 illustrated in FIG. 1.

FIG. 1 is a perspective view of a resonance structure 10 according to an embodiment. FIG. 2 is a perspective view of the resonance structure 10 illustrated in FIG. 1 viewed from a negative direction of the Z-axis. FIG. 3 is a perspective view of the resonance structure 10 illustrated in FIG. 1 that is partially disassembled. FIG. 4 is a cross-sectional view of the resonance structure 10 along the line L1-L1 illustrated in FIG. 1.

An XYZ coordinate system is used in FIG. 1 to FIG. 4. In a case of not specifically distinguishing between a positive direction of the X-axis and a negative direction of the X-axis, the positive direction of the X-axis and the negative direction of the X-axis are collectively referred to as "X-direction". In a case of not specifically distinguishing between a positive direction of the Y-axis and a negative direction of the Y-axis, the positive direction of the Y-axis and the negative direction of the Y-axis are collectively referred to as "Y-direction". In a case of not specifically distinguishing between a positive direction of the Z-axis and the negative direction of the Z-axis, the positive direction of the Z-axis and the negative direction of the Z-axis are collectively referred to as "Z-direction".

In FIG. 1 to FIG. 4, a first plane is represented as an XY-plane on the XYZ coordinate system. A first direction is represented as the X-direction. A second direction intersecting with the first direction is represented as the Y-direction.

The resonance structure 10 is configured to resonate at one or a plurality of resonance frequencies. As illustrated in FIG. 1 and FIG. 2, the resonance structure 10 includes a base body 20, a conductor part 30, and a ground conductor 40. The resonance structure 10 includes connection conductors 60-1, 60-2, 60-3, and 60-4. In the following description, in a case of not specifically distinguishing among the connection conductors 60-1 to 60-4, the connection conductors 60-1 to 60-4 are collectively referred to as "connection conductors 60". The number of the connection conductors 60 included in the resonance structure 10 is not limited to four. The resonance structure 10 may include a first predetermined number of the connection conductors 60. The first predetermined number is three or more. The resonance structure 10 may include at least one of a first feeding line 51 and a second feeding line 52 illustrated in FIG. 1.

The base body 20 may include a dielectric material. A relative permittivity of the base body 20 may be appropriately adjusted in accordance with a desired resonance frequency of the resonance structure 10.

The base body 20 is configured to support the conductor part 30 and the ground conductor 40. As illustrated in FIG. 1 and FIG. 2, the base body 20 has a quadrangular prism shape. However, the base body 20 may have any shape as long as it can support the conductor part 30 and the ground conductor 40. As illustrated in FIG. 4, the base body 20 includes an upper surface 21 and a lower surface 22. The upper surface 21 and the lower surface 22 extend along the XY-plane.

The conductor part 30 illustrated in FIG. 1 may include a conductive material. The conductor part 30, the ground conductor 40, the first feeding line 51, the second feeding line 52, and the connection conductor 60 may include the same conductive material, or may include different conductive materials.

The conductor part 30 illustrated in FIG. 1 is configured to function as part of a resonator. The conductor part 30 extends along the XY-plane. The conductor part 30 has a substantially square shape including two sides substantially parallel with the X-direction and two sides substantially parallel with the Y-direction. However, the conductor part 30 may have any shape. The conductor part 30 is positioned on the upper surface 21 of the base body 20. The resonance structure 10 may exhibit an artificial magnetic conductor character with respect to electromagnetic waves of a predetermined frequency that enter, from the outside, the upper surface 21 of the base body 20 on which the conductor part 30 is positioned.

In the present disclosure, the "artificial magnetic conductor character" means a characteristic of a surface on which a phase difference between entering incident waves and reflected waves being reflected becomes 0 degrees. On the surface having the artificial magnetic conductor character, the phase difference between the incident waves and the reflected waves becomes −90 degrees to +90 degrees in a frequency band.

As illustrated in FIG. 1, the conductor part 30 includes a gap Sx and a gap Sy. The gap Sx extends along the Y-direction. The gap Sx is positioned in the vicinity of the center of the side substantially parallel with the X-direction of the conductor part 30 in the X-direction. The gap Sy extends along the X-direction. The gap Sy is positioned in the vicinity of the center of the side substantially parallel with the Y-direction of the conductor part 30 in the Y-direction. The width of the gap Sx and the width of the gap Sy may be appropriately adjusted in accordance with a desired resonance frequency of the resonance structure 10.

As illustrated in FIG. 1, the conductor part 30 includes first conductors 31-1, 31-2, 31-3, and 31-4. In a case of not specifically distinguishing among the first conductors 31-1 to 31-4, the first conductors 31-1 to 31-4 are collectively referred to as "first conductors 31". The number of the first conductors 31 included in the conductor part 30 is not limited to four. The conductor part 30 may include any number of the first conductors 31.

The first conductors 31 illustrated in FIG. 1 may be have a flat plate shape. The first conductors 31 have the same shape, that is, a substantially square shape including two sides substantially parallel with the X-direction and two sides substantially parallel with the Y-direction. However, each of the first conductors 31-1 to 31-4 may have any shape. As illustrated in FIG. 1 and FIG. 3, each of the first conductors 31-1 to 31-4 is configured to be connected to one of the different connection conductors 60-1 to 60-4. As illustrated in FIG. 1, the first conductor 31 may include a connection part 31*a* at one of four corner parts of a square. The connection part 31*a* is configured to be connected to the connection conductor 60. The first conductor 31 does not necessarily include the connection part 31*a*. Some of the first conductors 31 may include the connection part 31*a*, and the others do not necessarily include the connection part 31*a*. The connection part 31*a* illustrated in FIG. 1 has a circular shape. However, the shape of the connection part 31*a* is not limited to the circular shape, but may be any shape.

Each of the first conductors 31-1 to 31-4 extends along the XY-plane. As illustrated in FIG. 1, the first conductor 31-1 to the first conductor 31-4 may be arranged in a square lattice shape along the X-direction and the Y-direction.

For example, the first conductor 31-1 and the first conductor 31-2 are arranged along the X-direction of a square lattice along the X-direction and the Y-direction. The first conductor 31-3 and the first conductor 31-4 are arranged along the X-direction of the square lattice along the X-direction and the Y-direction. The first conductor 31-1 and the first conductor 31-4 are arranged along the Y-direction of the square lattice along the X-direction and the Y-direction. The first conductor 31-2 and the first conductor 31-3 are arranged along the Y-direction of the square lattice along the X-direction and the Y-direction. The first conductor 31-1 and the first conductor 31-3 are arranged along a first diagonal direction of the square lattice along the X-direction and the Y-direction. The first diagonal direction is a direction inclined from the positive direction of the X-axis toward the positive direction of the Y-axis by 45 degrees. The first conductor 31-2 and the first conductor 31-4 are arranged along a second diagonal line of the square lattice along the X-direction and the Y-direction. A second diagonal direction is a direction inclined from the positive direction of the X-axis toward the positive direction of the Y-axis by 135 degrees.

However, the lattice along which the first conductors 31-1 to 31-4 are arranged is not limited to the square lattice. The first conductor 31-1 to the first conductor 31-4 may be optionally arranged. For example, the first conductors 31 may be arranged in an oblique lattice shape, a rectangular lattice shape, a triangular lattice shape, or a hexagonal lattice shape.

The first conductor 31 may include a portion that is configured to be capacitively connected to the different first conductor 31 due to the gap between itself and the different first conductor 31. For example, the first conductor 31-1 and the first conductor 31-2 may be configured to be capacitively coupled to each other due to the gap Sx therebetween. The first conductor 31-3 and the first conductor 31-4 may be configured to be capacitively coupled to each other due to the gap Sx therebetween. The first conductor 31-1 and the first conductor 31-4 may be configured to be capacitively coupled to each other due to the gap Sy therebetween. The first conductor 31-2 and the first conductor 31-3 may be configured to be capacitively coupled to each other due to the gap Sy therebetween. The first conductor 31-1 and the first conductor 31-3 may be configured to be capacitively coupled to each other due to the gap Sx and the gap Sy therebetween. The first conductor 31-1 and the first conductor 31-3 may be configured to be capacitively coupled to each other via the first conductor 31-2 and the first conductor 31-4. The first conductor 31-2 and the first conductor 31-4 may be configured to be capacitively coupled to each other due to the gap Sx and the gap Sy therebetween. The first conductor 31-2 and the first conductor 31-4 may be configured to be capacitively coupled to each other via the first conductor 31-1 and the first conductor 31-3.

As illustrated in FIG. 1, the resonance structure 10 may include capacitive elements C1 and C2 in the gap Sx. The resonance structure 10 may include capacitive elements C3 and C4 in the gap Sy. The capacitive elements C1 to C4 may be a chip capacitor and the like. The capacitive element C1 is positioned between the first conductor 31-1 and the first conductor 31-2 in the gap Sx. The capacitive element C1 is configured to capacitively connect the first conductor 31-1 with the first conductor 31-2. The capacitive element C2 is positioned between the first conductor 31-3 and the first conductor 31-4 in the gap Sx. The capacitive element C2 is configured to capacitively connect the first conductor 31-3 with the first conductor 31-4. The capacitive element C3 is positioned between the first conductor 31-2 and the first conductor 31-3 in the gap Sy. The capacitive element C3 is configured to capacitively connect the first conductor 31-2 with the first conductor 31-3. The capacitive element C4 is positioned between the first conductor 31-1 and the first conductor 31-4 in the gap Sy. The capacitive element C4 is configured to capacitively connect the first conductor 31-1 with the first conductor 31-4. The positions of the capacitive elements C1 and C2 in the gap Sx and the positions of the capacitive elements C3 and C4 in the gap Sy may be appropriately adjusted in accordance with a desired resonance frequency of the resonance structure 10. Capacitance values of the capacitive elements C1 to C4 may be appropriately adjusted in accordance with the desired resonance frequency of the resonance structure 10. When the capacitance values of the capacitive elements C1 to C4 are increased, the resonance frequency of the resonance structure 10 may be reduced. When the capacitance values of the capacitive elements C1 to C4 are reduced, the resonance frequency of the resonance structure 10 may be increased.

The ground conductor 40 illustrated in FIG. 2 may include a conductive material. The ground conductor 40 is configured to provide an electric potential as a reference in the resonance structure 10. The ground conductor 40 may be configured to be connected to a ground of an appliance including the resonance structure 10. The ground conductor 40 may be a conductor having a flat plate shape. As illustrated in FIG. 2, the ground conductor 40 is positioned on the lower surface 22 of the base body 20. On the negative direction side of the Z-axis of the ground conductor 40, various parts of an appliance including the resonance structure 10 may be positioned. By way of example, a metal plate may be positioned on the negative direction side of the Z-axis of the ground conductor 40. The resonance structure 10 as an antenna may be configured to maintain radiation efficiency at a predetermined frequency even when the metal plate is positioned on the negative direction side of the Z-axis of the ground conductor 40.

As illustrated in FIG. 2 and FIG. 3, the ground conductor 40 extends along the XY-plane. The ground conductor 40 is positioned separately from the conductor part 30. As illustrated in FIG. 4, the base body 20 is interposed between the ground conductor 40 and the conductor part 30. As illustrated in FIG. 3, the ground conductor 40 faces the conductor part 30 in the Z-direction. The ground conductor 40 has a shape corresponding to the shape of the conductor part 30. In the embodiment, as illustrated in FIG. 2, the ground conductor 40 has a substantially square shape corresponding to the conductor part 30 having a substantially square shape. However, the ground conductor 40 may have any shape corresponding to the shape of the conductor part 30.

The ground conductor 40 includes connection parts 40*a* at respective four corner parts of the square. The connection parts 40*a* are configured to be connected to the connection conductors 60. In the ground conductor 40, some of the connection parts 40*a* may be omitted. The connection part 40*a* illustrated in FIG. 2 has a circular shape. However, the shape of the connection part 40*a* is not limited to the circular shape, but may be any shape.

The first feeding line 51 and the second feeding line 52 illustrated in FIG. 3 may include a conductive material. Each of the first feeding line 51 and the second feeding line 52 may be a through-hole conductor, a via conductor, or the like. The first feeding line 51 and the second feeding line 52 may be positioned inside the base body 20.

The first feeding line 51 illustrated in FIG. 3 is configured to be electromagnetically connected to the first conductor 31-1 included in the conductor part 30 illustrated in FIG. 1. In the present disclosure, "electromagnetic connection" may be electrical connection or magnetic connection. The first feeding line 51 may extend to an external device and the like through an opening 41 of the ground conductor 40 illustrated in FIG. 2.

The first feeding line 51 is configured to supply electric power to the conductor part 30 via the first conductor 31-1. The first feeding line 51 is configured to supply electric power from the conductor part 30 to an external device and the like via the first conductor 31-1.

The second feeding line 52 illustrated in FIG. 3 is configured to be electromagnetically connected to the first conductor 31-2 included in the conductor part 30 illustrated in FIG. 1. The second feeding line 52 is configured to be electromagnetically connected to the conductor part 30 at a position different from that of the first feeding line 51. As illustrated in FIG. 2, the second feeding line 52 may extend through an opening 42 of the ground conductor 40 to an external device and the like.

The second feeding line 52 is configured to supply electric power to the conductor part 30 via the first conductor 31-2. The second feeding line 52 is configured to supply electric power from the conductor part 30 to an external device and the like via the first conductor 31-2.

The connection conductor 60 illustrated in FIG. 3 may include a conductive material. The connection conductor 60 extends from the ground conductor 40 to the conductor part 30. The connection conductor 60 may be a through-hole conductor, a via conductor, or the like. The connection conductors 60-1 to 60-4 are configured to connect the first conductors 31-1 to 31-4 with the ground conductor 40.

First Example of Resonance State

The connection conductor 60-1 and the connection conductor 60-4 illustrated in FIG. 1 may be one set. The connection conductor 60-2 and the connection conductor 60-3 may be one set. The set of the connection conductors 60-1 and 60-4 and the set of the connection conductors 60-2 and 60-3 are a first connection pair arranged along the X-direction as the first direction. The set of the connection conductors 60-1 and 60-4 and the set of the connection conductors 60-2 and 60-3 are the first connection pair arranged along the X-direction in which a set of the first conductors 31-1 and 31-4 and the set of the first conductors 31-2 and 31-3 are arranged in the square lattice in which the first conductors 31 are arranged.

The resonance structure 10 is configured to resonate at a first frequency along a first path parallel with the X-direction. The first path is part of a first current path through the set of the connection conductors 60-1 and 60-4 and the set of the connection conductors 60-2 and 60-3 as the first connection pair. The first current path includes: the ground conductor 40; the set of the first conductors 31-1 and 31-4; the set of the first conductors 31-2 and 31-3; and the set of the connection conductors 60-1 and 60-4 and the set of the connection conductors 60-2 and 60-3 that are the first connection pair. FIG. 4 illustrates part of the first current path as a current path I.

The set of the connection conductors 60-1 and 60-4 and the set of the connection conductors 60-2 and 60-3 may be configured to function as a pair of electric walls when the resonance structure 10 resonates at the first frequency along the first path parallel with the X-direction. A set of the connection conductors 60-1 and 60-2 and a set of the connection conductors 60-3 and 60-4 may be configured to function as a pair of magnetic walls when viewed from a current flowing through the first current path including the first path when the resonance structure 10 resonates at the first frequency along the first path parallel with the X-direction. The set of the connection conductors 60-1 and 60-4 and the set of the connection conductors 60-2 and 60-3 function as a pair of electric walls, and the set of the connection conductors 60-1 and 60-2 and the set of the connection conductors 60-3 and 60-4 function as a pair of magnetic walls, so that the resonance structure 10 may be configured to exhibit the artificial magnetic conductor character with respect to electromagnetic waves that enter, from the outside, the upper surface 21 of the base body 20 on which the conductor part 30 is positioned and that are polarized along the first path at the first frequency.

The resonance structure 10 may be configured, as an antenna, to radiate polarized electromagnetic waves along the first path parallel with the X-direction when electric power is supplied from the first feeding line 51 to the conductor part 30.

Second Example of Resonance State

The connection conductor 60-1 and the connection conductor 60-2 may be one set. The connection conductor 60-3 and the connection conductor 60-4 may be one set. The set of the connection conductors 60-1 and 60-2 and the set of the connection conductors 60-3 and 60-4 are a second connection pair arranged along the Y-direction as the second direction. The set of the connection conductors 60-1 and 60-2 and the set of the connection conductors 60-3 and 60-4 are the second connection pair arranged along the Y-direction in which a set of the first conductors 31-1 and 31-2 and a set of the first conductors 31-3 and 31-4 are arranged in the square lattice in which the first conductors 31 are arranged.

The resonance structure 10 is configured to resonate at a second frequency along a second path parallel with the Y-direction. The second path is part of a second current path through the set of the connection conductors 60-1 and 60-2 and the set of the connection conductors 60-3 and 60-4 as the second connection pair. The second current path includes: the ground conductor 40; the set of the first conductors 31-1 and 31-2; the set of the first conductors 31-3 and 31-4; and the set of the connection conductors 60-1 and 60-2 and the set of the connection conductors 60-3 and 60-4 that are the second connection pair.

The set of the connection conductors 60-1 and 60-2 and the set of the connection conductors 60-3 and 60-4 may be configured to function as a pair of electric walls when the resonance structure 10 resonates at the second frequency along the second path parallel with the Y-direction. The set of the connection conductors 60-2 and 60-3 and the set of the connection conductors 60-1 and 60-4 may be configured to function as a pair of magnetic walls when viewed from a current flowing through the second current path including the second path when the resonance structure 10 resonates at the second frequency along the second path. The set of the connection conductors 60-1 and 60-2 and the set of the connection conductors 60-3 and 60-4 function as a pair of electric walls, and the set of the connection conductors 60-2 and 60-3 and the set of the connection conductors 60-1 and 60-4 function as a pair of magnetic walls, so that the resonance structure 10 may be configured to exhibit the artificial magnetic conductor character with respect to electromagnetic waves that enter, from the outside, the upper surface 21 of the base body 20 on which the conductor part 30 is positioned and that are polarized along the second path at the second frequency.

The resonance structure 10 may radiate, as an antenna, polarized electromagnetic waves along the second path substantially parallel with the Y-direction when electric power is supplied from the second feeding line 52 to the conductor part 30.

In the resonance structure 10, as illustrated in FIG. 1, the conductor part 30 has a substantially square shape. In the resonance structure 10, the conductor part 30 has a substantially square shape, so that the length of the first current path may be equal to the length of the second current path. In the resonance structure 10, the length of the first current path is equal to the length of the second current path, so that the first frequency may be equal to the second frequency.

However, the resonance structure 10 may be configured so that the first frequency is different from the second frequency depending on a use and the like thereof. For example, the resonance structure 10 may be configured such that the conductor part 30 has a rectangular shape to cause the length of the first current path to be different from the length of the second current path, and to cause the first frequency to be different from the second frequency.

Figure 5:
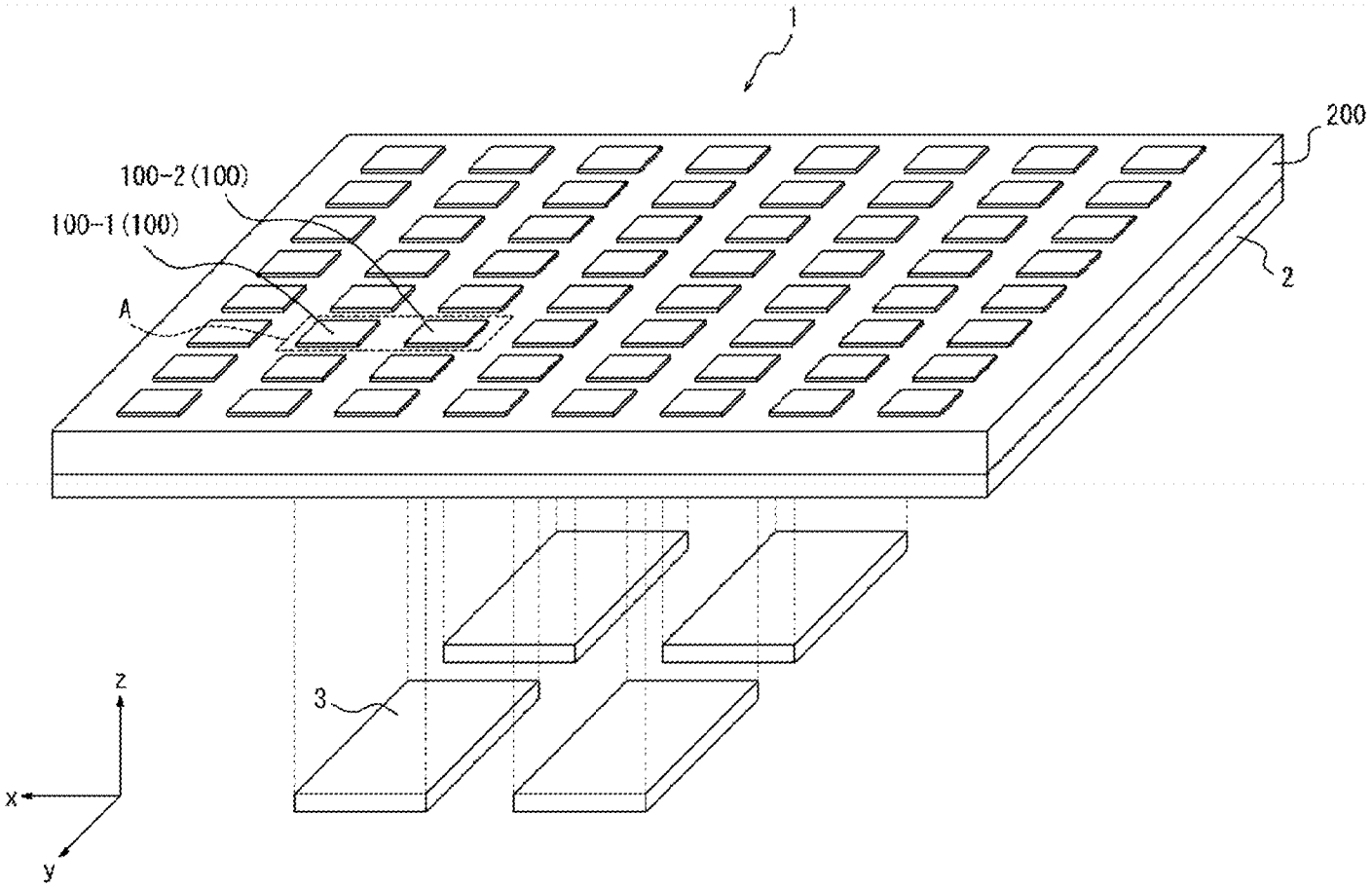
FIG. 5 is a perspective view of an array antenna according to an embodiment.
Figure 6:
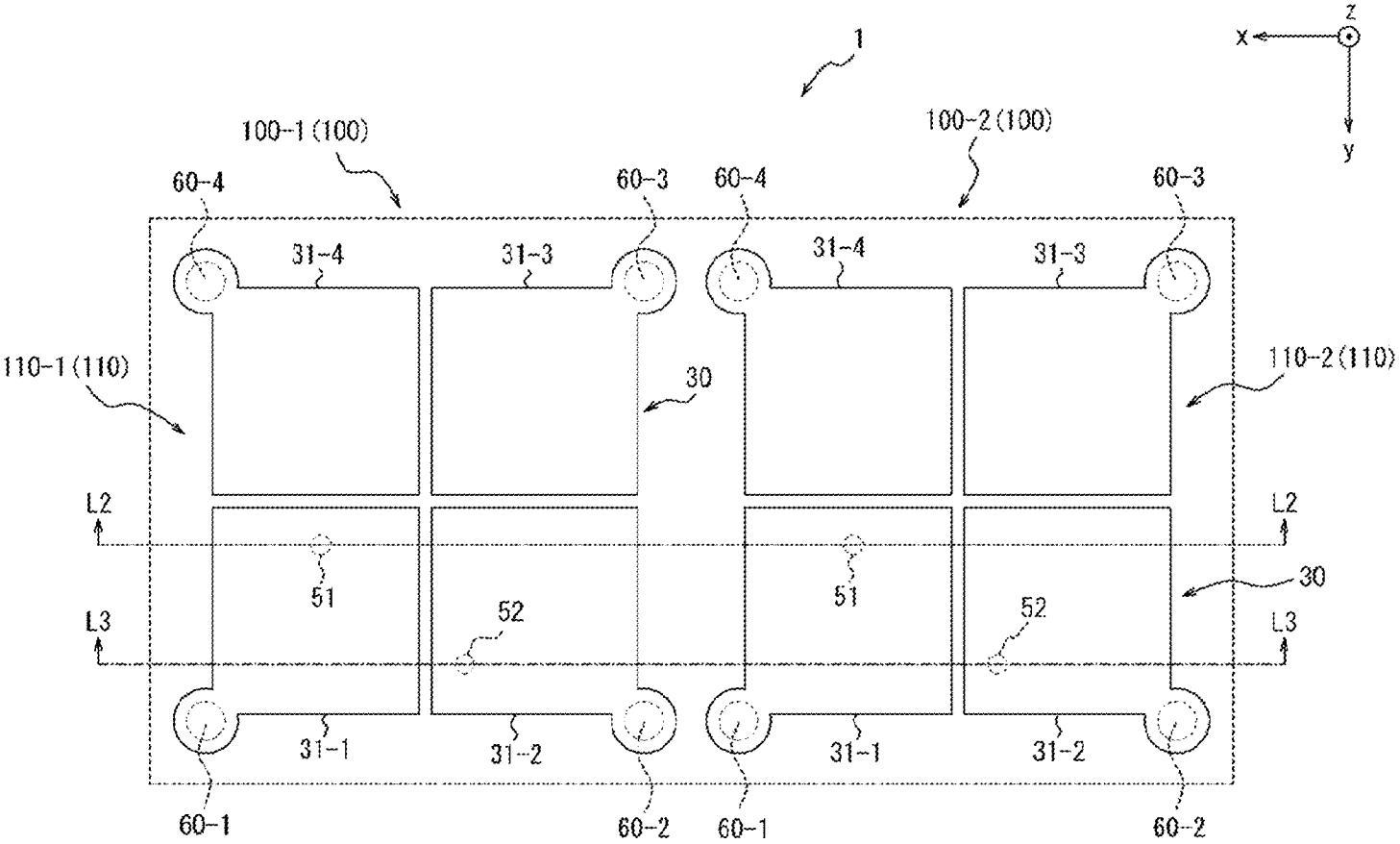
FIG. 6 is an enlarged view of the array antenna in the area A illustrated in FIG. 5.
Figure 7:
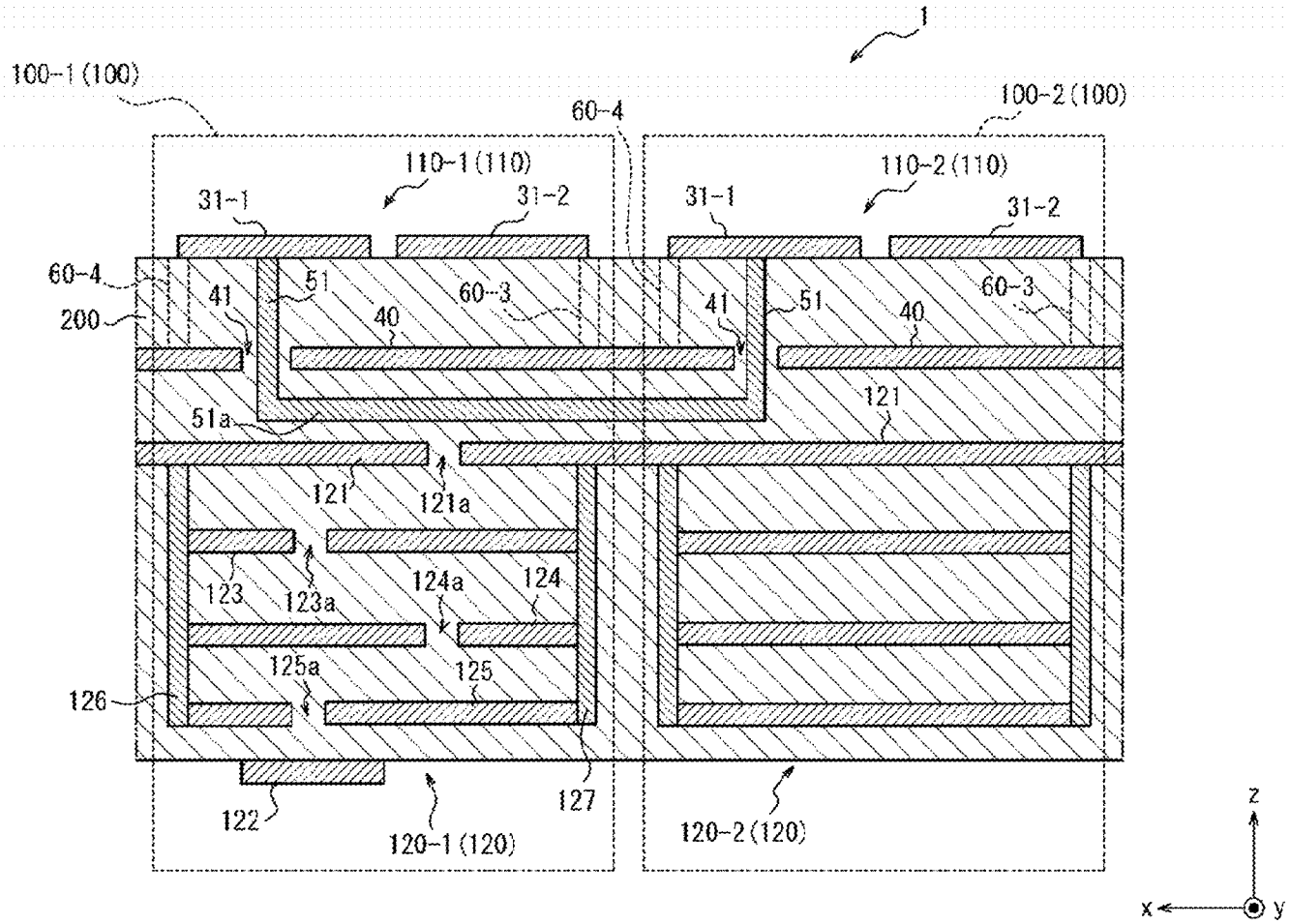
FIG. 7 is a cross-sectional view of the array antenna along the line L2-L2 illustrated in FIG. 6.
Figure 8:
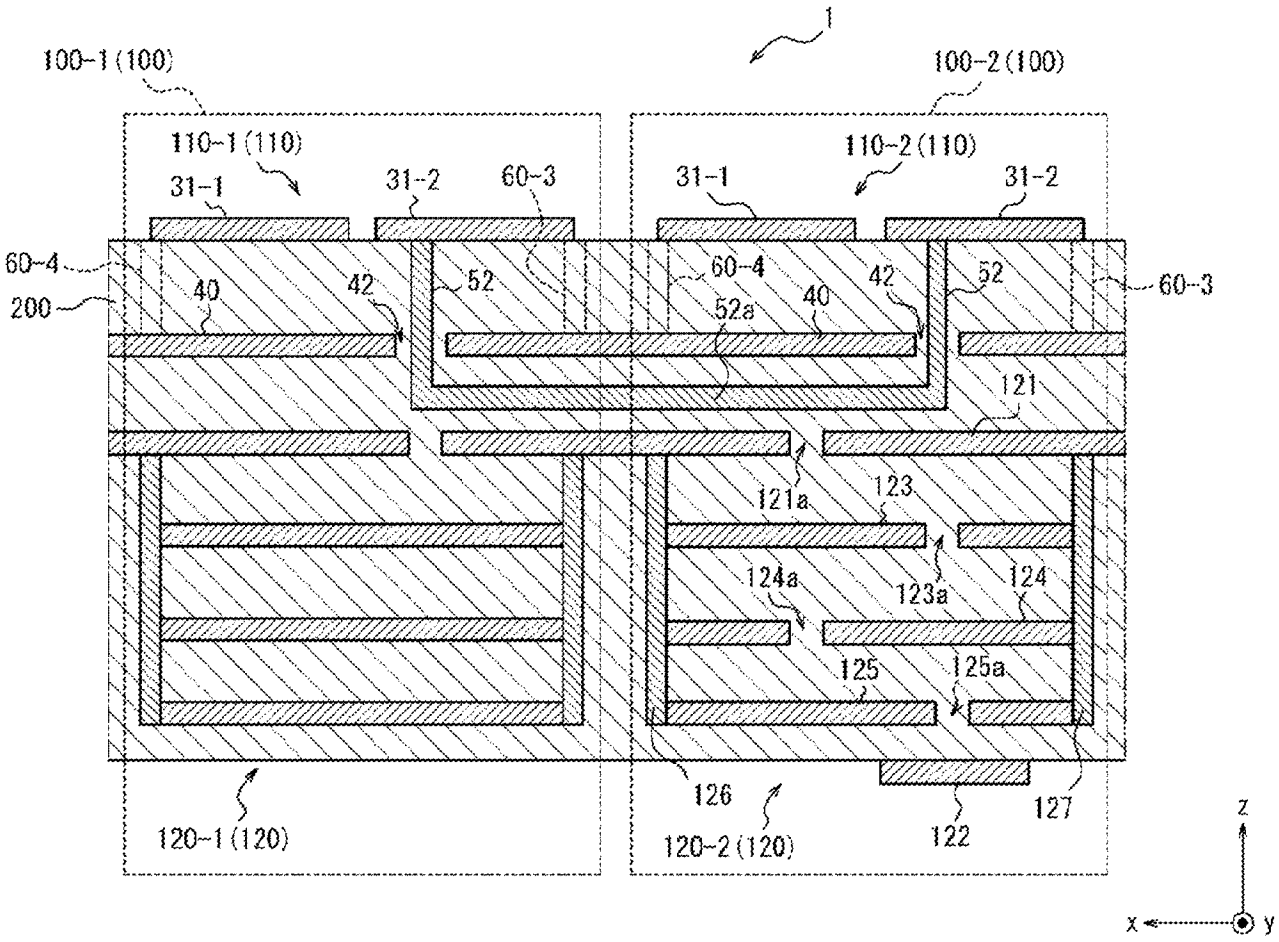
FIG. 8 is a cross-sectional view of the array antenna along the line L3-L3 illustrated in FIG. 6.
Figure 9:
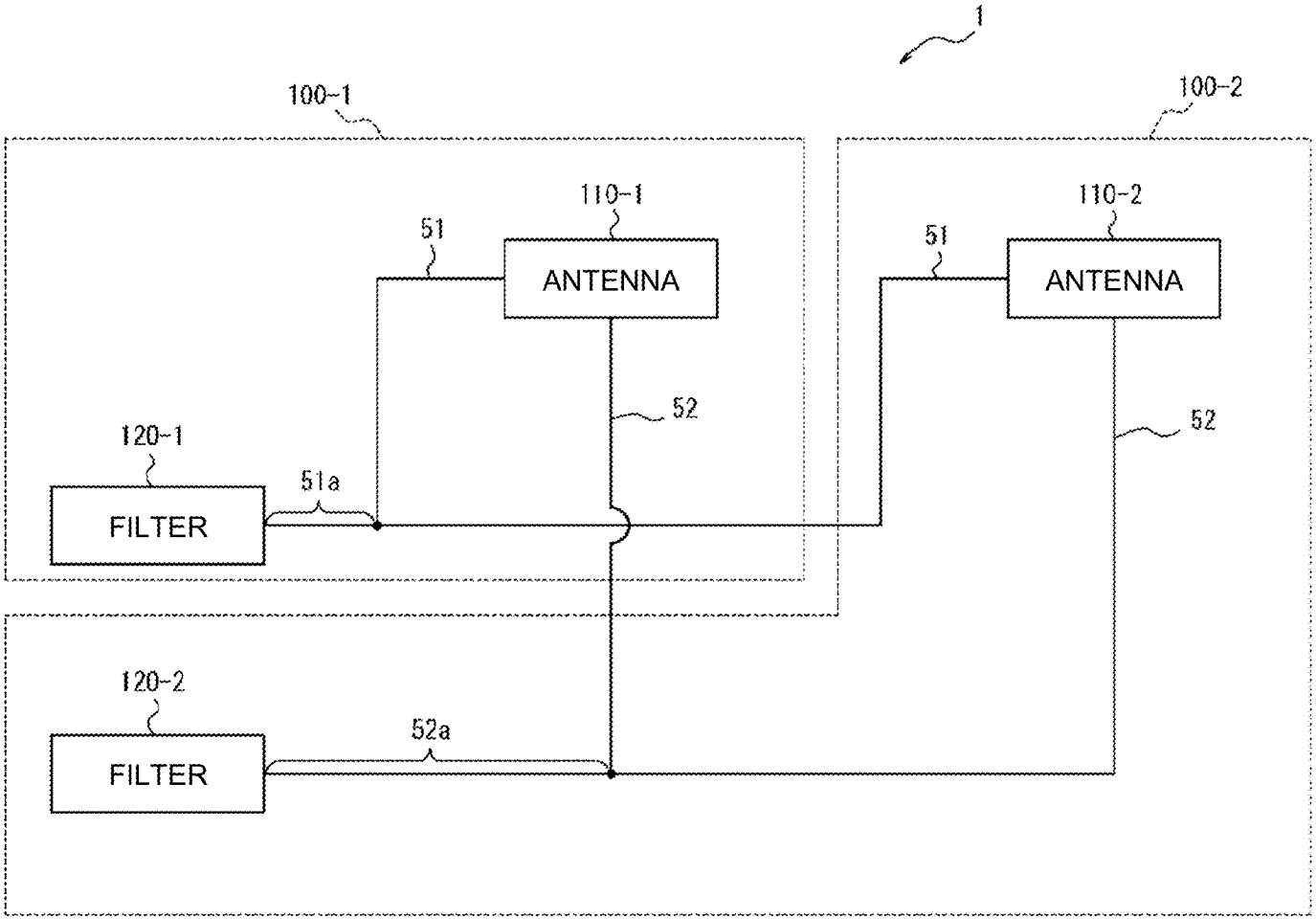
FIG. 9 is a circuit diagram of antenna elements illustrated in FIG. 6.

FIG. 5 is a perspective view of an array antenna 1 according to an embodiment. FIG. 6 is an enlarged view of the array antenna 1 in the area A illustrated in FIG. 5. FIG. 7 is a cross-sectional view of the array antenna 1 along the line L2-L2 illustrated in FIG. 6. FIG. 8 is a cross-sectional view of the array antenna 1 along the line L3-L3 illustrated in FIG. 6. FIG. 9 is a circuit diagram of antenna elements 100-1 and 100-2 illustrated in FIG. 6.

In the following drawings, the xyz coordinate system is used. In a case of not specifically distinguishing between a positive direction of the x-axis and a negative direction of the x-axis, the positive direction of the x-axis and the negative direction of the x-axis are collectively referred to as the "x-direction". In a case of not specifically distinguishing between a positive direction of the y-axis and a negative direction of the y-axis, the positive direction of the y-axis and the negative direction of the y-axis are collectively referred to as the "y-direction". In a case of not specifically distinguishing between a positive direction of the z-axis and a negative direction of the z-axis, the positive direction of the z-axis and the negative direction of the z-axis are collectively referred to as the "z-direction".

In the following drawings, a fourth direction is represented as the x-direction. A fifth direction intersecting with the fourth direction is represented as the y-direction. An eighth direction is represented as the z-direction. The xyz coordinate system illustrated in FIG. 5, for example, may correspond to the XYZ coordinate system illustrated in FIG. 1, for example. In this case, the fourth direction, that is, the x-direction illustrated in FIG. 5 may correspond to the X-direction illustrated in FIG. 1 as the first direction, or the Y-direction illustrated in FIG. 1 as the second direction.

The array antenna 1 illustrated in FIG. 5 may be positioned on a circuit board 2. The array antenna 1 may be configured to be connected to an integrated circuit 3 via the circuit board 2. The integrated circuit 3 may be a radio frequency integrated circuit (RFIC). The array antenna 1 may be directly connected to the integrated circuit 3, not through the circuit board 2. In the configuration in which the array antenna 1 is directly connected to the integrated circuit 3, the array antenna 1 is not necessarily positioned on the circuit board 2. The array antenna 1 includes the antenna element 100-1 (first antenna element), the antenna element 100-2 (second antenna element), and an antenna substrate 200.

In the following description, in a case of not specifically distinguishing between the antenna elements 100-1 and 100-2, the antenna elements 100-1 and 100-2 are collectively referred to as "antenna elements 100". The array antenna 1 may include an optional number of the antenna elements 100.

The antenna elements 100 are arranged in a square lattice shape along the x-direction and the y-direction. However, the lattice in which the antenna elements 100 are arranged is not limited to the square lattice. The antenna elements 100 may be optionally arranged. For example, the antenna elements 100 may be arranged in an oblique lattice shape, a rectangular lattice shape, a triangular lattice shape, or a hexagonal lattice shape.

As illustrated in FIG. 7 and FIG. 8, the antenna elements 100 may be integrated with the antenna substrate 200.

As illustrated in FIG. 6, the antenna element 100-1 and the antenna element 100-2 may be arranged along the x-direction. The antenna element 100-1 and the antenna element 100-2 may be adjacent to each other.

As illustrated in FIG. 9, the antenna element 100-1 includes an antenna 110-1 (first antenna) and a filter 120-1 (first filter). As illustrated in FIG. 9, the antenna element 100-2 includes an antenna 110-2 (second antenna) and a filter 120-2 (second filter).

In the following description, in a case of not specifically distinguishing between the antennas 110-1 and 110-2, the antennas 110-1 and 110-2 are collectively referred to as "antennas 110". In the following description, in a case of not specifically distinguishing between the filters 120-1 and 120-2, the filters 120-1 and 120-2 are collectively referred to as "filters 120".

In the embodiment, the resonance structure 10 illustrated in FIG. 1 is employed for the antenna 110. However, any resonance structure may be employed for the antenna 110. As illustrated in FIG. 6 and FIG. 7, the antenna 110 includes the conductor part 30 including the first conductors 31-1 to 31-4, the ground conductor 40, the first feeding line 51, the second feeding line 52, and the connection conductors 60-1 to 60-4. As illustrated in FIG. 7 and FIG. 8, the ground conductor 40 of the antenna 110-1 and the ground conductor 40 of the antenna 110-2 may be integrated with each other.

As illustrated in FIG. 7, the first feeding line 51 of the antenna 110-1 and the first feeding line 51 of the antenna 110-2 are configured to be electrically connected to wiring 51*a*. The wiring 51*a* is positioned between the ground conductor 40 and a ground conductor 121 of the filter 120. The wiring 51*a* is configured to be electromagnetically connected to the filter 120-1. In the embodiment, the wiring 51*a* is configured to be magnetically connected to the filter 120-1. For example, the wiring 51*a* covers an opening 121*a* of the ground conductor 121 of the filter 120-1 on the xy-plane. The wiring 51*a* covers the opening 121*a* of the ground conductor 121 of the filter 120-1, so that the wiring 51*a* may be configured to be magnetically connected to the filter 120-1.

The wiring 51*a* is electromagnetically connected to the filter 120-1, so that the antenna 110-1 may be configured to be electromagnetically connected to the filter 120-1 via the wiring 51*a* and the first feeding line 51 of the antenna 110-1 as illustrated in FIG. 9. The wiring 51*a* is electromagnetically connected to the filter 120-1, so that the antenna 110-2 may be configured to be electromagnetically connected to the filter 120-1 via the wiring 51*a* and the first feeding line 51 of the antenna 110-2.

The antenna 110-1 is configured to radiate, as electromagnetic waves polarized along the x-direction illustrated in FIG. 6, electric power that is supplied from the filter 120-1 illustrated in FIG. 9 via the first feeding line 51. The antenna 110-1 is configured to supply, to the filter 120-1 via the first feeding line 51 illustrated in FIG. 9, electromagnetic waves polarized along the x-direction among the electromagnetic waves that enter the antenna 110-1 from the outside.

The antenna 110-2 is configured to radiate, as electromagnetic waves polarized along the x-direction illustrated in FIG. 6, electric power supplied from the filter 120-1 illustrated in FIG. 9 via the first feeding line 51. The antenna 110-2 is configured to supply, to the filter 120-1 via the first feeding line 51 illustrated in FIG. 9, electromagnetic waves polarized along the x-direction among the electromagnetic waves that enter the antenna 110-2 from the outside.

As illustrated in FIG. 8, the second feeding line 52 of the antenna 110-1 and the second feeding line 52 of the antenna 110-2 are configured to be electrically connected to wiring 52*a*. The wiring 52*a* is positioned between the ground conductor 40 and the ground conductor 121 of the filter 120. The wiring 52*a* is configured to be electromagnetically connected to the filter 120-2. In the embodiment, the wiring 52*a* is configured to be magnetically connected to the filter 120-2. For example, the wiring 52*a* covers the opening 121*a* of the ground conductor 121 of the filter 120-2 on the xy-plane. The wiring 52*a* covers the opening 121*a* of the ground conductor 121 of the filter 120-2, so that the wiring 52*a* may be configured to be magnetically connected to the filter 120-2.

The wiring 52*a* is electromagnetically connected to the filter 120-2, so that the antenna 110-1 may be configured to be electromagnetically connected to the filter 120-2 via the wiring 52*a* and the second feeding line 52 of the antenna 110-1 as illustrated in FIG. 9. The wiring 52*a* is electromagnetically connected to the filter 120-2, so that the antenna 110-2 may be configured to be electromagnetically connected to the filter 120-2 via the wiring 52*a* and the second feeding line 52 of the antenna 110-2.

The antenna 110-1 is configured to radiate, as electromagnetic waves polarized along the y-direction illustrated in FIG. 6, electric power supplied from the filter 120-2 illustrated in FIG. 9 via the second feeding line 52. The antenna 110-1 is configured to supply, to the filter 120-2 via the second feeding line 52 illustrated in FIG. 9, electromagnetic waves polarized along the y-direction among the electromagnetic waves that enter the antenna 110-1 from the outside.

The antenna 110-2 is configured to radiate, as electromagnetic waves polarized along the y-direction illustrated in FIG. 6, electric power supplied from the filter 120-2 illustrated in FIG. 9 via the second feeding line 52. The antenna 110-2 is configured to supply, to the filter 120-2 via the second feeding line 52 illustrated in FIG. 9, electromagnetic waves polarized along the y-direction among the electromagnetic waves that enter the antenna 110-2 from the outside.

As illustrated in FIG. 7, the filter 120-1 is configured to be electromagnetically connected to the first feeding line 51 of the antenna 110-1 and the first feeding line 51 of the antenna 110-2 via the wiring 51*a*. The filter 120-1 is positioned to be overlapped with the ground conductor 40 of the antenna 110-1. The position of the filter 120-1 on the xy-plane may be the same as the position of the antenna 110-1 on the xy-plane, or in the vicinity thereof. The filter 120-1 may be positioned in the antenna substrate 200.

As illustrated in FIG. 8, the filter 120-2 is configured to be electromagnetically connected to the second feeding line 52 of the antenna 110-1 and the second feeding line 52 of the antenna 110-2 via the wiring 52*a*. The filter 120-2 is positioned to be overlapped with the ground conductor 40 of the antenna 110-2. The position of the filter 120-2 on the xy-plane may be the same as the position of the antenna 110-2 on the xy-plane, or in the vicinity thereof. The filter 120-2 may be positioned in the antenna substrate 200.

The filter 120 is a laminated waveguide filter. However, the filter 120 is not limited to the laminated waveguide filter. Any structure may be employed for the filter 120 depending on a use and the like of the array antenna 1. As illustrated in FIG. 7 and FIG. 8, the filter 120 includes the ground conductor 121, wiring 122, conductors 123, 124, and 125, and conductors 126 and 127. The filter 120 may include any number of the conductors 123 and the like.

The ground conductor 121 may include a conductive material. Members included in the ground conductor 121, the wiring 122, the conductors 123 to 125, the conductors 126 and 127, and the antenna 110 may include the same conductive material, or may include different conductive materials. As illustrated in FIG. 7 and FIG. 8, the ground conductor 121 includes the opening 121*a*. The ground conductor 121 of the filter 120-1 and the ground conductor 121 of the filter 120-2 may be formed integrally.

As illustrated in FIG. 7, the ground conductor 121 of the filter 120-1 is overlapped with the ground conductor 40 of the antenna 110-1. The opening 121*a* of the ground conductor 121 of the filter 120-1 faces the wiring 51*a*.

As illustrated in FIG. 8, the ground conductor 121 of the filter 120-2 is overlapped with the ground conductor 40 of the antenna 110-2. The opening 121*a* of the ground conductor 121 of the filter 120-2 faces the wiring 52*a*.

The wiring 122 illustrated in FIG. 7 and FIG. 8 may include a conductive material. The wiring 122 covers an opening 125*a* of the conductor 125 on the xy-plane. The wiring 122 is configured to be electrically connected to the circuit board 2 illustrated in FIG. 5. The wiring 122 is configured to be electrically connected to the integrated circuit 3 via the circuit board 2 illustrated in FIG. 5. In a configuration in which the array antenna 1 illustrated in FIG. 5 is directly connected to the integrated circuit 3, the wiring 122 may be configured to be electrically connected to the integrated circuit 3 directly.

The conductors 123 to 125 may include a conductive material. The conductors 123 to 125 are configured to function as part of a laminated waveguide. The conductors 123, 124, and 125 include openings 123*a*, 124*a*, and 125*a*, respectively. The conductors 123 to 125 are positioned so that the openings 123*a* to 125*a* are opposed to each other in the z-direction. The conductors 123 to 125 are configured to be electromagnetically coupled to each other via the respective openings 123*a* to 125*a*.

The conductor 126 illustrated in FIG. 7 and FIG. 8 extends along the z-direction in the vicinity of one of ends of the filter 120. A plurality of the conductors 126 arranged in the y-direction are configured to be electrically connected to each other via the conductors 123 to 125 extending in the y-direction. The conductor 127 illustrated in FIG. 7 and FIG. 8 extends along the z-direction in the vicinity of the other one of the ends of the filter 120. The conductors 126 arranged in the y-direction are configured to be electrically connected to each other via the conductors 123 to 125 extending in the y-direction.

The antenna substrate 200 illustrated in FIG. 7 and FIG. 8 may include a dielectric material in the same manner as or similarly to the base body 20 illustrated in FIG. 1. The antenna elements 100 are arranged on the antenna substrate 200.

In this way, as illustrated in FIG. 7, the antenna element 100 includes the antenna 110, and the filter 120 that is positioned to be overlapped with the ground conductor 40 of the antenna 110. The filter 120 is overlapped with the ground conductor 40 of the antenna 110, so that the antenna element 100 may be downsized. Accordingly, the antenna element 100 that has been improved may be provided. When the antenna element 100 is downsized, the array antenna 1 may be downsized. Accordingly, the array antenna 1 that has been improved may be provided.

Figure 10:
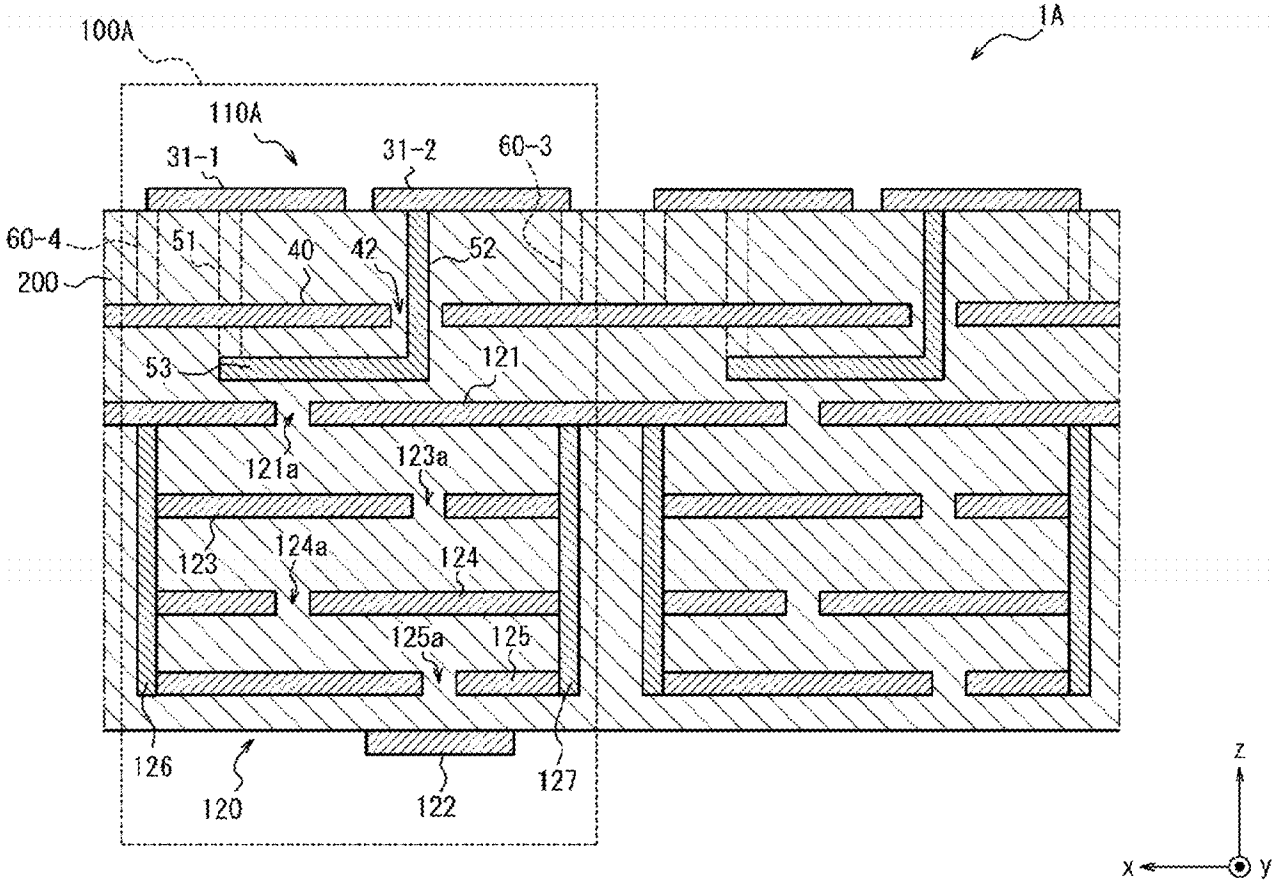
FIG. 10 is a cross-sectional view of an array antenna according to another embodiment.
Figure 11:
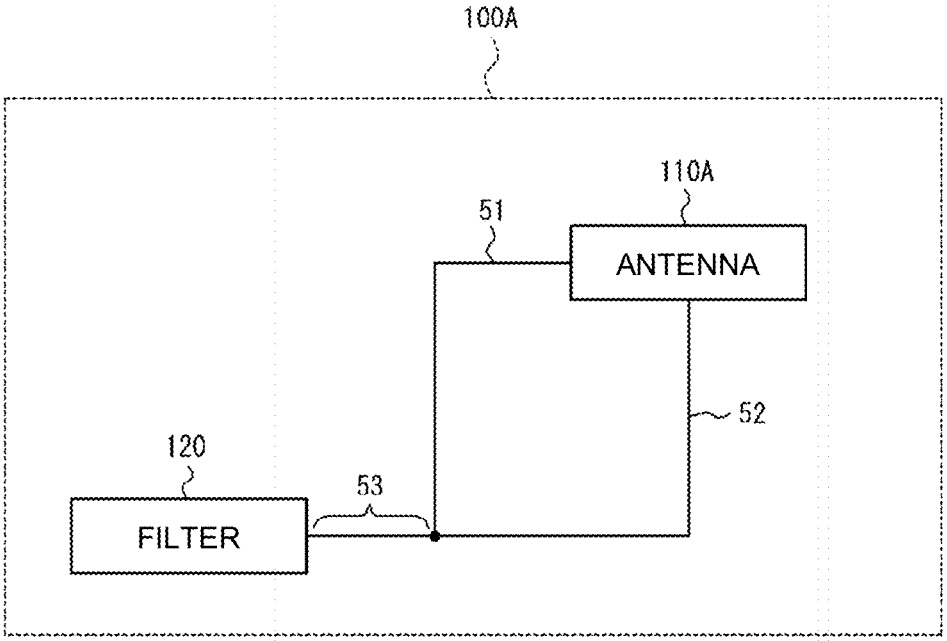
FIG. 11 is a circuit diagram of an antenna element illustrated in FIG. 10.

FIG. 10 is a cross-sectional view of an array antenna 1A according to another embodiment. FIG. 11 is a circuit diagram of an antenna element 100A illustrated in FIG. 10. The array antenna 1A is another embodiment of the array antenna 1 illustrated in FIG. 5. The cross-sectional view illustrated in FIG. 10 corresponds to the cross-sectional view along the line L3-L3 illustrated in FIG. 6.

The array antenna 1A includes a plurality of the antenna elements 100A and the antenna substrate 200. An appearance configuration of the array antenna 1A is the same as or similar to that of the array antenna 1 illustrated in FIG. 5. The antenna elements 100A may be arranged in a square lattice shape on the antenna substrate 200 in the same manner as or similarly to the antenna elements 100 illustrated in FIG. 5. As illustrated in FIG. 10 and FIG. 11, the antenna element 100A includes an antenna 110A and the filter 120.

As illustrated in FIG. 10, the first feeding line 51 of the antenna 110A and the second feeding line 52 of the antenna 110A are configured to be electrically connected to wiring 53. The wiring 53 is positioned between the ground conductor 40 and the ground conductor 121 of the filter 120. The wiring 53 is configured to be electromagnetically connected to the filter 120. In the embodiment, the wiring 53 is configured to be magnetically connected to the filter 120. For example, the wiring 53 covers the opening 121*a* of the ground conductor 121 of the filter 120. The wiring 53 covering the opening 121*a* of the ground conductor 121 of the filter 120, so that the wiring 53 may be configured to be magnetically connected to the filter 120.

The wiring 53 is electromagnetically connected to the filter 120, so that the antenna 110A may be configured to be electromagnetically connected to the filter 120 via the first feeding line 51 and the second feeding line 52 as illustrated in FIG. 11.

The antenna 110A is configured to radiate, as electromagnetic waves, electric power supplied from the filter 120 via the first feeding line 51 and the second feeding line 52. The antenna 110A is configured to supply, to the filter 120 via the first feeding line 51 and the second feeding line 52, electromagnetic waves that enter the antenna 110A from the outside.

The filter 120 is configured to be electromagnetically connected to the first feeding line 51 and the second feeding line 52 of the antenna 110A via the wiring 53.

Other configurations and effects of the array antenna 1A illustrated in FIG. 10 are the same as or similar to the configurations and effects of the array antenna 1 illustrated in FIG. 5.

Figure 12:
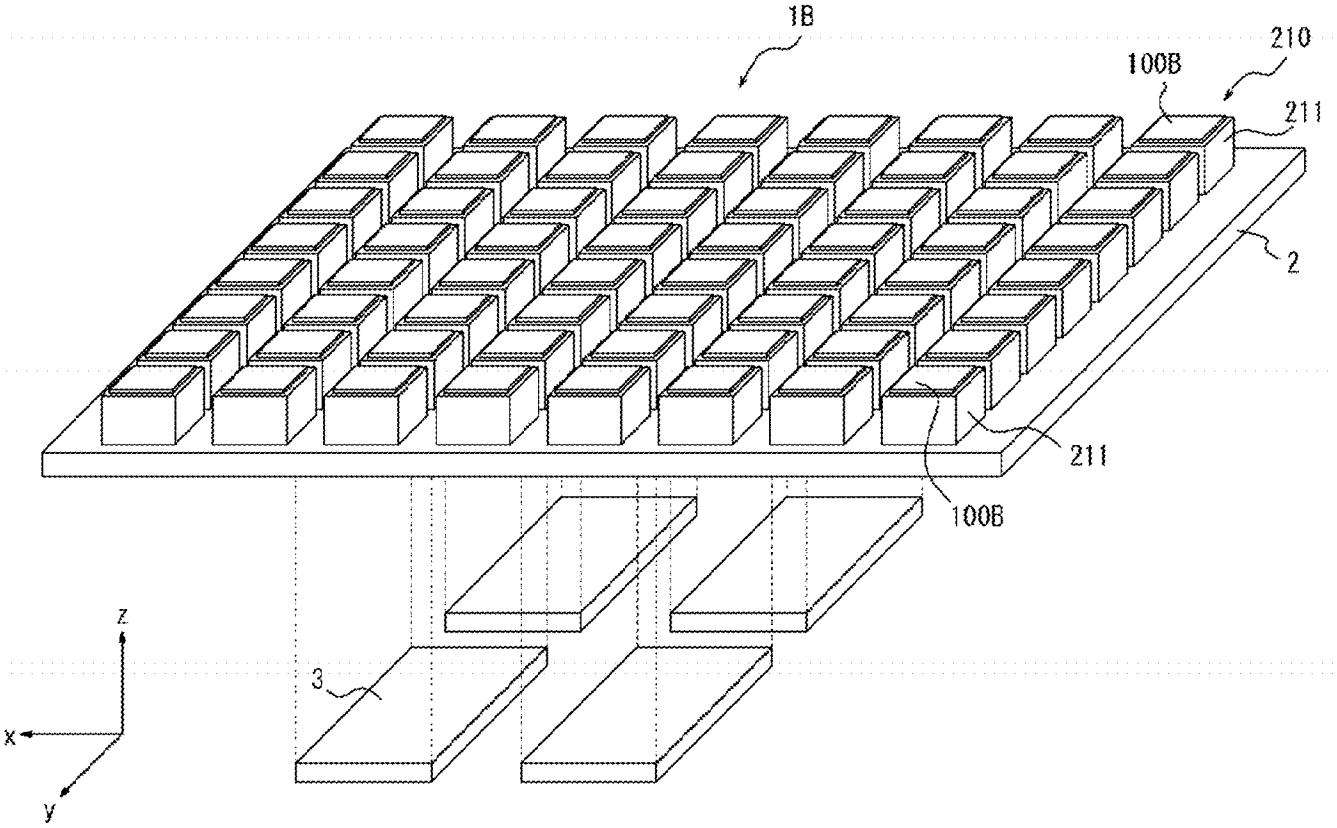
FIG. 12 is a perspective view of an array antenna according to an embodiment.
Figure 13:
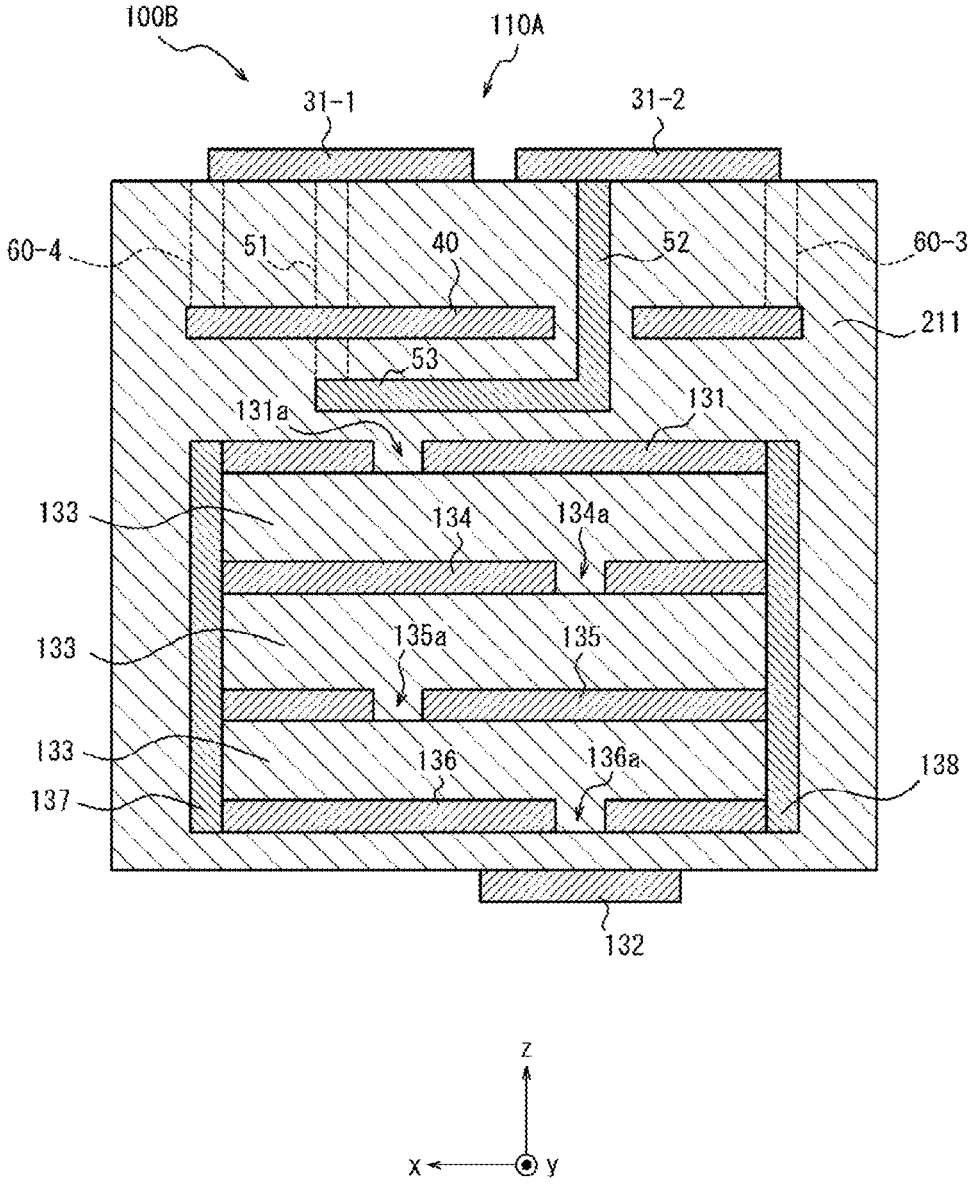
FIG. 13 is a cross-sectional view of the array antenna illustrated in FIG. 12.

FIG. 12 is a perspective view of an array antenna 1B according to an embodiment. FIG. 13 is a cross-sectional view of the array antenna 1B illustrated in FIG. 12. The cross-sectional view illustrated in FIG. 13 corresponds to the cross-sectional view along the line L3-L3 illustrated in FIG. 6.

The array antenna 1B illustrated in FIG. 12 is configured to be electrically connected to the integrated circuit 3 via the circuit board 2 in the same manner as or similarly to the configuration illustrated in FIG. 5. The array antenna 1B includes a plurality of antenna elements 100B and an antenna substrate 210.

As illustrated in FIG. 13, the antenna element 100B includes the antenna 110A and a filter 130.

A circuit configuration of the antenna element 100B may be the same as or similar to the configuration illustrated in FIG. 11. The antenna 110A may be configured to be electromagnetically connected to the filter 130 via the first feeding line 51 and the second feeding line 52.

For example, as illustrated in FIG. 13, the first feeding line 51 of the antenna 110A and the second feeding line 52 of the antenna 110A are configured to be electrically connected to the wiring 53. The wiring 53 is positioned between the ground conductor 40 and a ground conductor 131 of the filter 130. The wiring 53 is configured to be electromagnetically connected to the filter 130 in the same manner as or similarly to the structure illustrated in FIG. 10. The wiring 53 is electromagnetically connected to the filter 130, so that the antenna 110A may be configured to be electromagnetically connected to the filter 130 via the first feeding line 51 and the second feeding line 52.

The antenna 110A is configured to radiate, as electromagnetic waves, electric power supplied from the filter 130 via the first feeding line 51 and the second feeding line 52. The antenna 110A is configured to supply, to the filter 130 via the first feeding line 51 and the second feeding line 52, electromagnetic waves that enter the antenna 110A from the outside.

As illustrated in FIG. 13, the filter 130 is configured to be electromagnetically connected to the first feeding line 51 and the second feeding line 52 of the antenna 110A via the wiring 53. The filter 130 is positioned to be overlapped with the ground conductor 40 of the antenna 110A. The position of the filter 130 on the xy-plane may be the same as the position of the antenna 110A on the xy-plane, or in the vicinity thereof. The filter 130 may be positioned in a substrate part 211 of the antenna substrate 210.

The filter 130 is a dielectric filter. However, the filter 130 is not limited to the dielectric filter. Any structure may be employed for the filter 130 depending on a use and the like of the array antenna 1B. As illustrated in FIG. 13, the filter 130 includes the ground conductor 131, wiring 132, three dielectric blocks 133, conductors 134, 135, and 136, and conductors 137 and 138. The filter 130 may include any number of the dielectric blocks 133.

The ground conductor 131 may include a conductive material. Members included in the ground conductor 131, the wiring 132, the conductors 134 to 136, the conductors 137 and 138, and the antenna 110A may include the same conductive material, or may include different conductive materials. The ground conductor 131 includes an opening 131*a*. The opening 131*a* of the ground conductor 131 faces the wiring 53.

The wiring 132 may include a conductive material. The wiring 132 covers an opening 136*a* of the conductor 136 on the xy-plane. The wiring 132 is configured to be electrically connected to the circuit board 2 illustrated in FIG. 12. The wiring 132 is configured to be electrically connected to the integrated circuit 3 via the circuit board 2 illustrated in FIG. 12. In a configuration in which the array antenna 1B illustrated in FIG. 12 is directly connected to the integrated circuit 3, the wiring 132 may be configured to be electrically connected to the integrated circuit 3 directly.

The dielectric block 133 may include a dielectric material. A permittivity of the dielectric block 133 may be appropriately selected depending on a use and the like of the array antenna 1B.

The conductors 134 to 136 may include a conductive material. The conductors 134, 135, and 136 include openings 134*a*, 135*a*, and 136*a*, respectively. The conductors 134 to 136 are positioned so that the openings 134*a* to 136*a* are opposed to each other in the z-direction. The conductors 134 to 136 are configured to be electromagnetically coupled to each other via the respective openings 134*a* to 136*a*.

The conductors 137 and 138 may include a conductive material. The conductor 137 is positioned on one of two surfaces substantially parallel with the zy-plane included in the dielectric block 133. The conductor 138 is positioned on the other one of the two surfaces substantially parallel with the zy-plane included in the dielectric block 133. Each of the conductors 137 and 138 extends along the zy-plane.

The antenna substrate 210 illustrated in FIG. 12 may include a dielectric material in the same manner as or similarly to the base body 20 illustrated in FIG. 1. The antenna substrate 210 includes a plurality of the substrate parts 211. As illustrated in FIG. 12 and FIG. 13, one antenna element 100B is arranged on the substrate part 211. However, any number of the antenna elements 100B may be arranged on the substrate part 211 illustrated in FIG. 12.

In the array antenna 1B, the substrate parts 211 may be appropriately arranged in accordance with the arrangement of the antenna elements 100B. For example, in a configuration in which the antenna elements 100B are arranged in a square lattice shape along the x-direction and y-direction, the substrate parts 211 may be arranged in a square lattice shape along the x-direction and y-direction. For example, in a configuration in which the antenna elements 100B are arranged in a linear shape along the x-direction or y-direction, the substrate parts 211 may be arranged along the x-direction or y-direction.

Other configurations and effects of the array antenna 1B may be the same as or similar to the configurations and effects of the array antenna 1 illustrated in FIG. 5.

Figure 14:
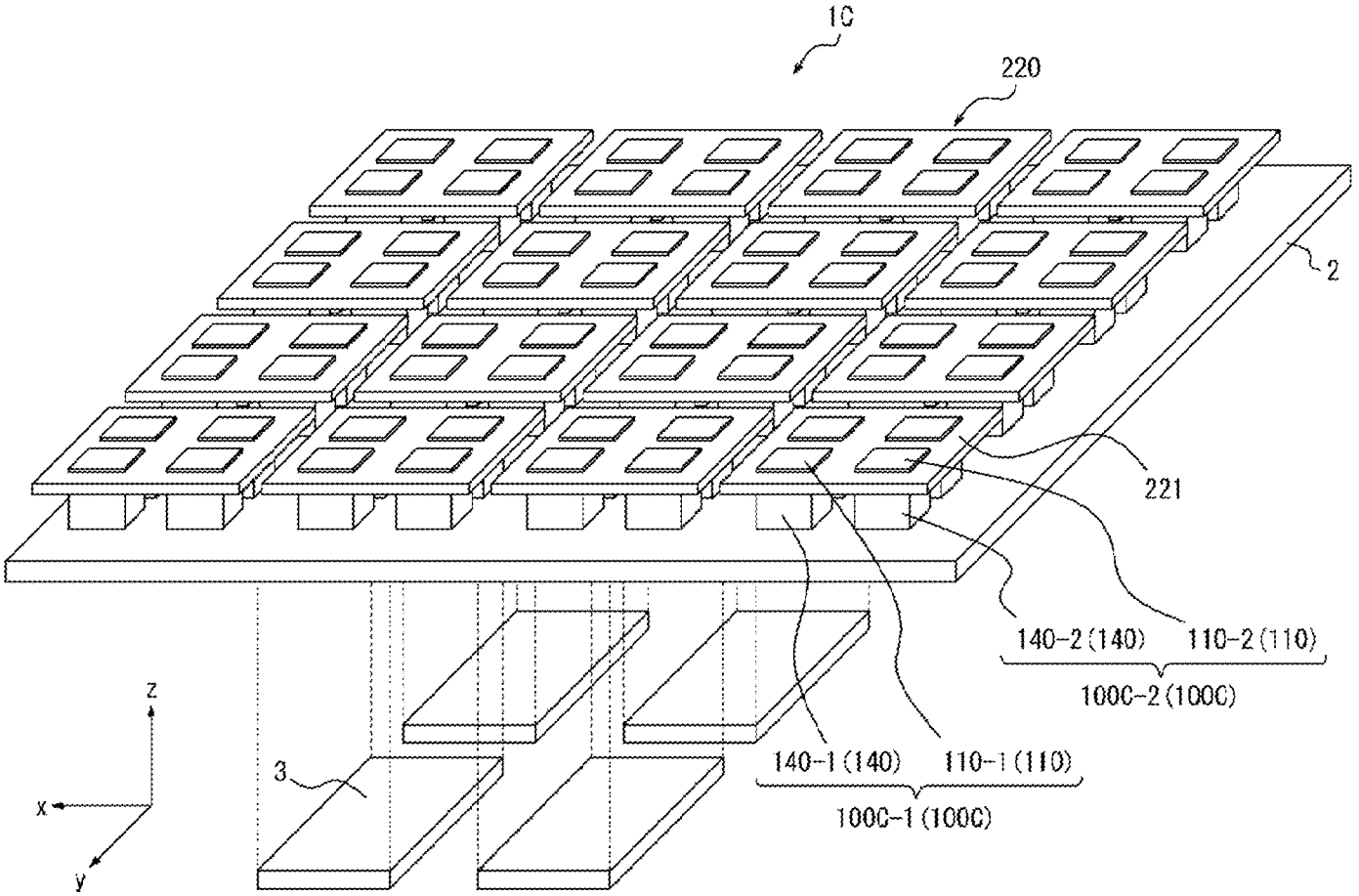
FIG. 14 is a perspective view of an array antenna according to an embodiment.
Figure 15:
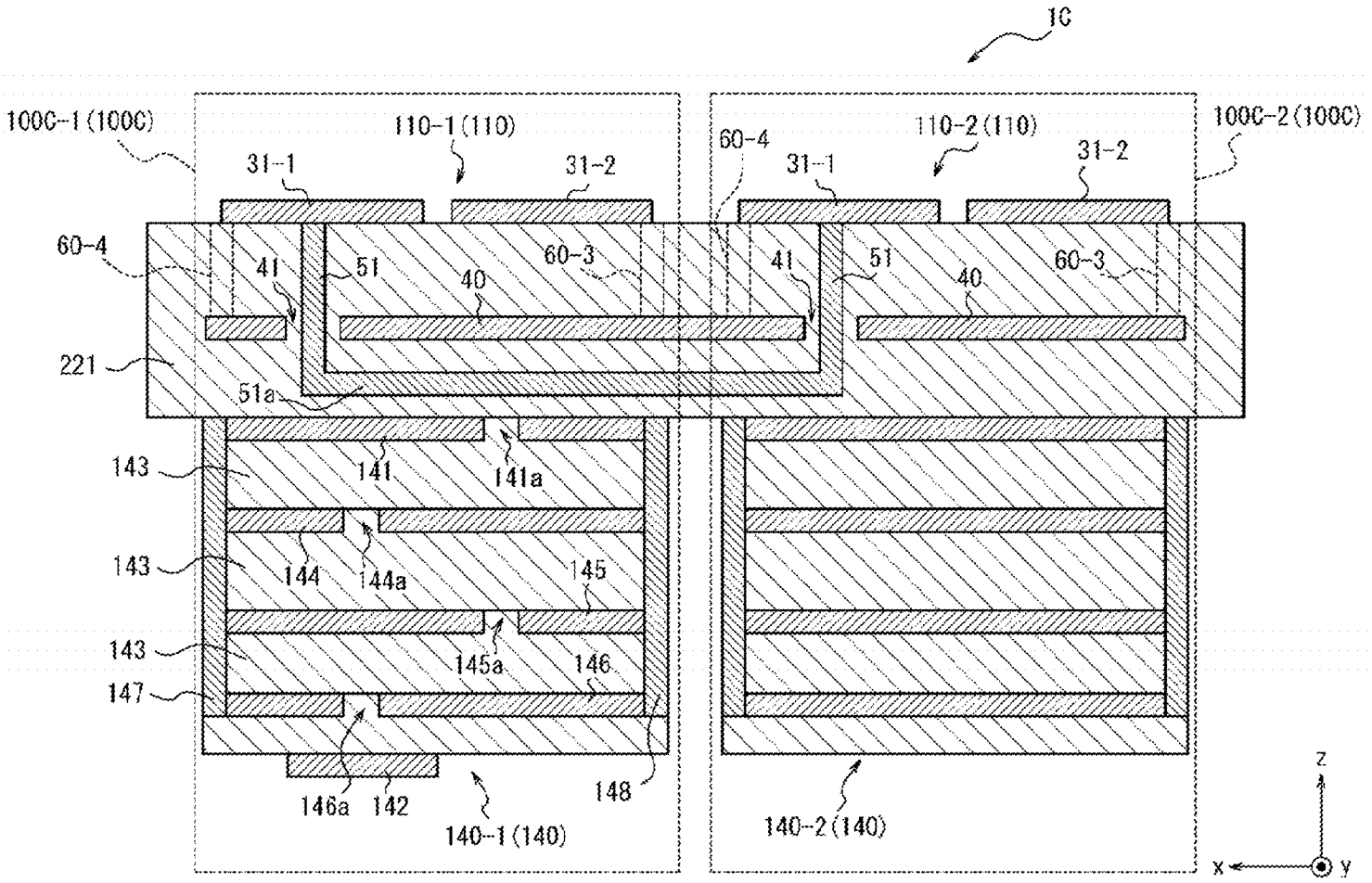
FIG. 15 is a cross-sectional view of the array antenna illustrated in FIG. 14 (part 1).
Figure 16:
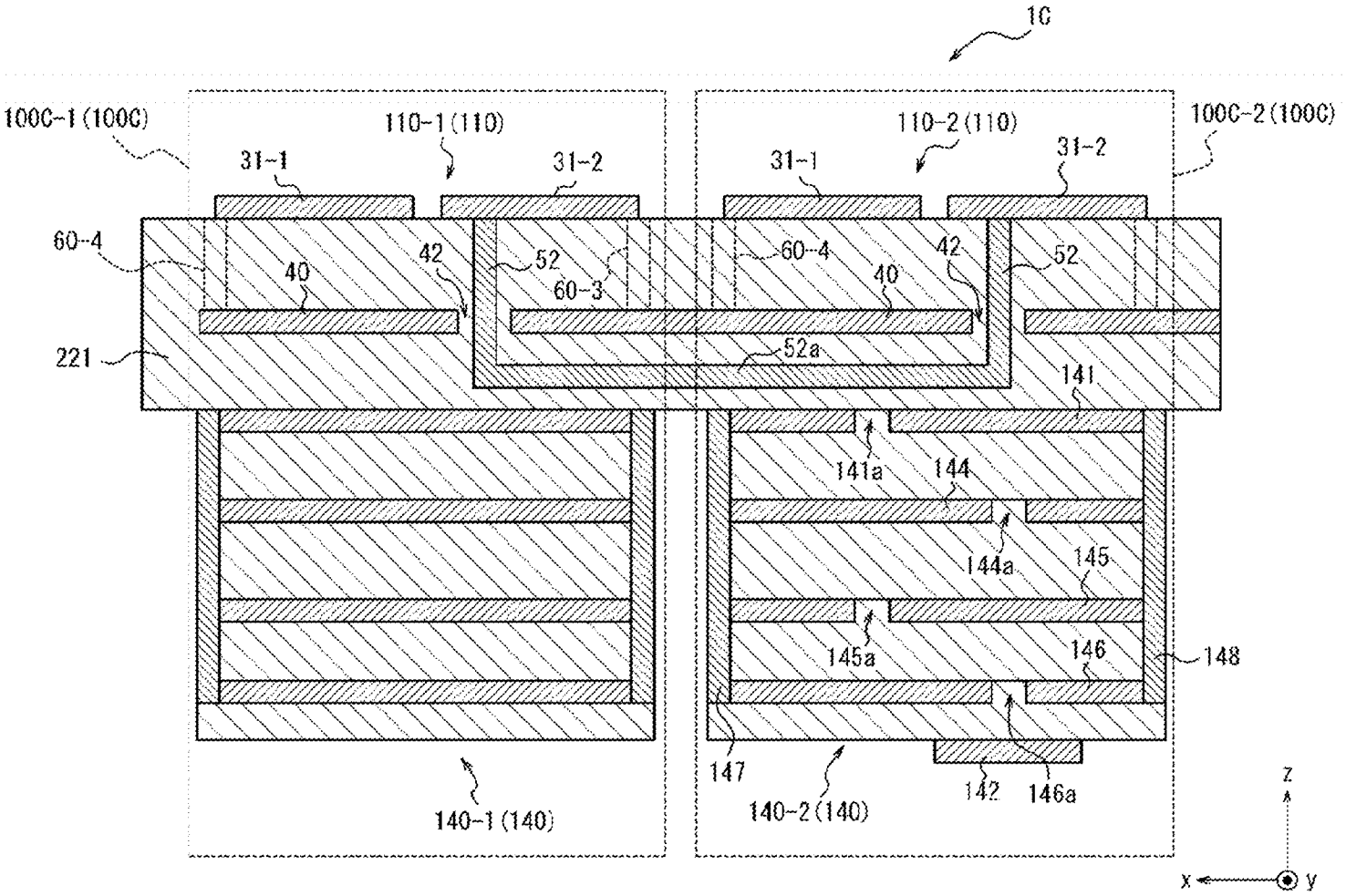
FIG. 16 is a cross-sectional view of the array antenna illustrated in FIG. 14 (part 2).

FIG. 14 is a perspective view of an array antenna 1C according to an embodiment. FIG. 15 is a cross-sectional view of the array antenna 1C illustrated in FIG. 14 (part 1). The cross-sectional view illustrated in FIG. 15 corresponds to the cross-sectional view along L2-L2 illustrated in FIG. 6. FIG. 16 is a cross-sectional view of the array antenna 1C illustrated in FIG. 14 (part 2). The cross-sectional view illustrated in FIG. 16 corresponds to the cross-sectional view along L3-L3 illustrated in FIG. 6.

The array antenna 1C illustrated in FIG. 14 is electrically connected to the integrated circuit 3 via the circuit board 2. The array antenna 1C includes an antenna element 100C-1 (first antenna element), an antenna element 100C-2 (second antenna element), and an antenna substrate 220.

In the following description, in a case of not specifically distinguishing between the antenna elements 100C-1 and 100C-2, the antenna elements 100C-1 and 100C-2 are collectively referred to as "antenna elements 100C". The array antenna 1 may include an optional number of the antenna elements 100C.

The antenna elements 100C are arranged in a lattice shape on the antenna substrate 220. For example, as illustrated in FIG. 14, the four antenna elements 100C are arranged in a square lattice shape on a substrate part 221 of the antenna substrate 220.

The antenna element 100C-1 includes an antenna 110-1 and a filter 140-1. The antenna element 100C-2 includes the antenna 110-2 and a filter 140-2. In the following description, in a case of not specifically distinguishing between the filters 140-1 and 140-2, the filters 140-1 and 140-2 are collectively referred to as "filters 140".

Circuit configurations of the antenna elements 100C-1 and 100C-2 may be the same as or similar to the circuit configuration illustrated in FIG. 9. Each of the antenna elements 100C-1 and 100C-2 is configured to be electromagnetically connected to the filter 140-1 via the first feeding line 51 thereof and the wiring 51*a*. Each of the antenna elements 100C-1 and 100C-2 is configured to be electromagnetically connected to the filter 140-2 via the second feeding line 52 thereof and the wiring 52*a*.

As illustrated in FIG. 15, the filter 140-1 is configured to be electromagnetically connected to the first feeding line 51 of the antenna 110-1 and the first feeding line 51 of the antenna 110-2 via the wiring 51*a*. The filter 140-1 is positioned to be overlapped with the ground conductor 40 of the antenna 110-1. The position of the filter 140-1 on the xy-plane may be the same as the position of the antenna 110-1 on the xy-plane, or in the vicinity thereof.

As illustrated in FIG. 16, the filter 140-2 is configured to be electromagnetically connected to the second feeding line 52 of the antenna 110-1 and the second feeding line 52 of the antenna 110-2 via the wiring 52*a*. The filter 140-2 is positioned to be overlapped with the ground conductor 40 of the antenna 110-2. The position of the filter 140-2 on the xy-plane may be the same as the position of the antenna 110-2 on the xy-plane, or in the vicinity thereof.

The filter 140 is a dielectric filter. However, the filter 140 is not limited to the dielectric filter. Any structure may be employed for the filter 140 depending on a use and the like of the array antenna 1C. As illustrated in FIG. 15 and FIG. 16, the filter 140 includes a ground conductor 141, wiring 142, three dielectric blocks 143, conductors 144, 145, and 146, and conductors 147 and 148. The filter 140 may include any number of the dielectric blocks 143.

The ground conductor 141 may include a conductive material. Members included in the ground conductor 141, the wiring 142, the conductors 144 to 146, the conductors 147 and 148, and the antenna 110 may include the same conductive material, or may include different conductive materials. As illustrated in FIG. 15 and FIG. 16, the ground conductor 141 includes an opening 141*a*.

As illustrated in FIG. 15, the ground conductor 141 of the filter 140-1 is overlapped with the ground conductor 40 of the antenna 110-1. The opening 141*a* of the ground conductor 141 of the filter 140-1 faces the wiring 51*a*.

As illustrated in FIG. 16, the ground conductor 141 of the filter 140-2 is overlapped with the ground conductor 40 of the antenna 110-2. The opening 141*a* of the ground conductor 141 of the filter 140-2 faces the wiring 52*a*.

The wiring 142 illustrated in FIG. 15 and FIG. 16 may include a conductive material. The wiring 142 covers an opening 146*a* of the conductor 146 on the xy-plane. The wiring 142 is configured to be electrically connected to the circuit board 2 illustrated in FIG. 14. The wiring 142 is configured to be electrically connected to the integrated circuit 3 via the circuit board 2 illustrated in FIG. 14. In a configuration in which the array antenna 1 illustrated in FIG. 14 is directly connected to the integrated circuit 3, the wiring 142 may be configured to be electrically connected to the integrated circuit 3 directly.

The dielectric block 143 may include a dielectric material. A permittivity of the dielectric block 143 may be appropriately selected depending on a use and the like of the array antenna 1C.

The conductors 144 to 146 may include a conductive material. The conductors 144, 145, and 146 include openings 144*a*, 145*a*, and 146*a*, respectively. The conductors 144 to 146 are positioned so that the openings 144*a* to 146*a* are opposed to each other in the z-direction. The conductors 144 to 146 are configured to be electromagnetically coupled to each other via the respective openings 144*a* to 146*a*.

The conductors 147 and 148 may include a conductive material. The conductor 147 is positioned on one of two surfaces substantially parallel with the zy-plane included in the dielectric block 143. The conductor 148 is positioned on the other one of the two surfaces substantially parallel with the zy-plane included in the dielectric block 143. Each of the conductors 147 and 148 extends along the zy-plane.

The antenna substrate 220 illustrated in FIG. 14 may include a dielectric material in the same manner as or similarly to the base body 20 illustrated in FIG. 1. The antenna substrate 220 includes a plurality of the substrate parts 221. The four antenna elements 100C are arranged on the substrate part 221. The four antenna elements 100C are arranged in a square lattice shape along the x-direction and the y-direction on the substrate part 221. However, the number of the antenna elements 100C arranged on the substrate part 221 is not limited to four. At least one antenna element 100C may be positioned on the substrate part 221.

In the array antenna 1C, the substrate parts 221 may be appropriately arranged in accordance with the arrangement of the antenna elements 100. For example, in a configuration in which the antenna elements 100C are arranged in a square lattice shape along the x-direction and y-direction, the substrate parts 221 may be arranged in a square lattice shape along the x-direction and y-direction.

Other configurations and effects of the array antenna 1C are the same as or similar to the configurations and effects of the array antenna 1 illustrated in FIG. 5.

Figure 17:
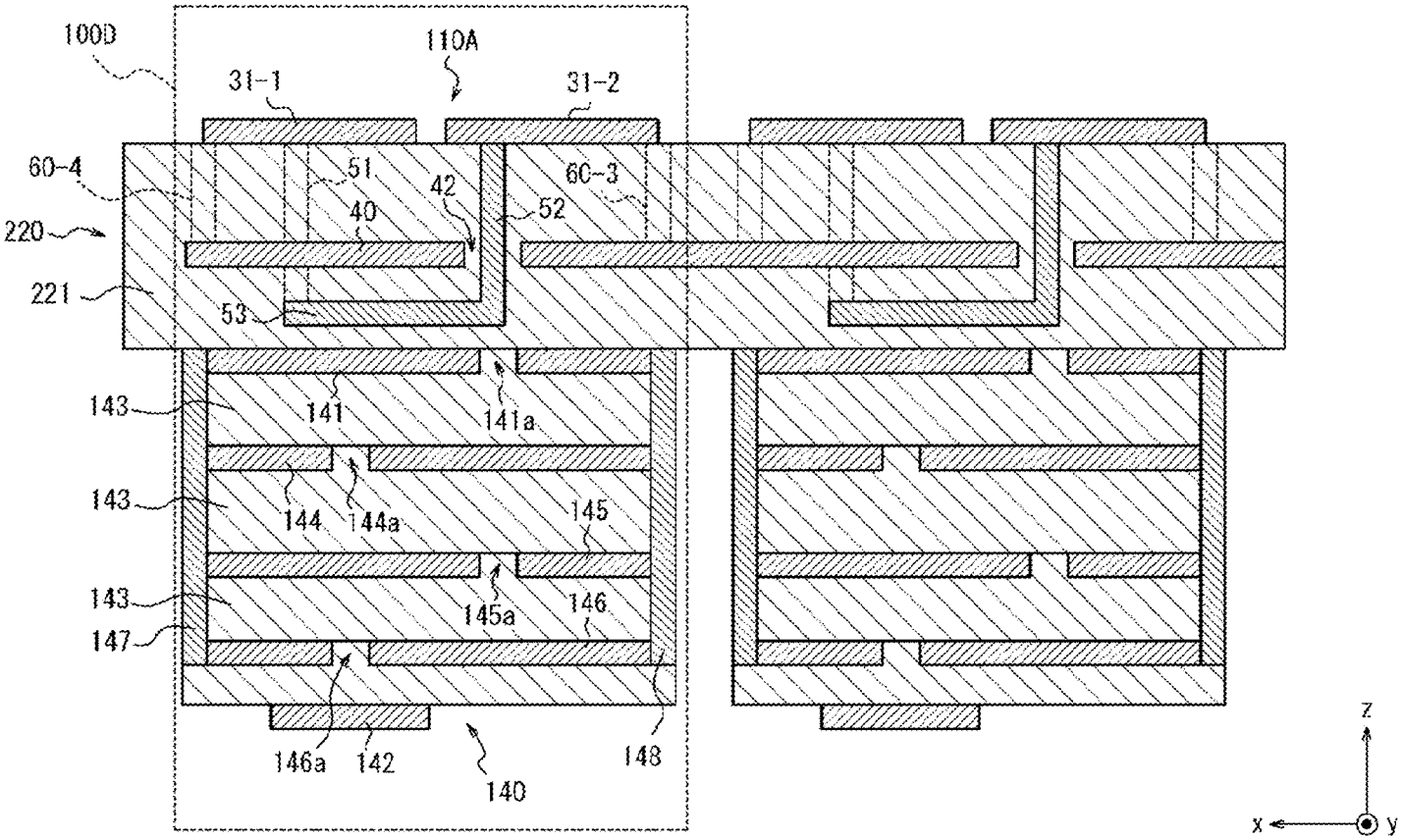
FIG. 17 is a cross-sectional view of an array antenna according to another embodiment.

FIG. 17 is a cross-sectional view of an array antenna 1D according to another embodiment. The cross-sectional view illustrated in FIG. 17 corresponds to the cross-sectional view along the line L3-L3 illustrated in FIG. 6. The array antenna 1D is another embodiment of the array antenna 1C illustrated in FIG. 14.

The array antenna 1D includes a plurality of antenna elements 100D and the antenna substrate 220. The antenna elements 100D may be arranged in a square lattice shape on the substrate part 221 of the antenna substrate 220 in the same manner as or similarly to the configuration illustrated in FIG. 14.

The antenna element 100D includes the antenna 110A and the filter 140. A circuit configuration of the antenna element 100D may be the same as or similar to the circuit configuration illustrated in FIG. 11. The antenna 110A is configured to be electromagnetically connected to the filter 140 via the first feeding line 51 and the second feeding line 52.

For example, as illustrated in FIG. 17, the first feeding line 51 of the antenna 110A and the second feeding line 52 of the antenna 110A are configured to be electrically connected to the wiring 53. The wiring 53 is positioned between the ground conductor 40 and the ground conductor 141 of the filter 140. The wiring 53 is configured to be electromagnetically connected to the filter 140 in the same manner as or similarly to the configuration illustrated in FIG. 10. The wiring 53 is electromagnetically connected to the filter 140, so that the antenna 110A may be configured to be electromagnetically connected to the filter 140 via the first feeding line 51 and the second feeding line 52.

Other configurations and effects of the array antenna 1D illustrated in FIG. 17 are the same as or similar to the configurations and effects of the array antenna 1 illustrated in FIG. 5.

Figure 18:
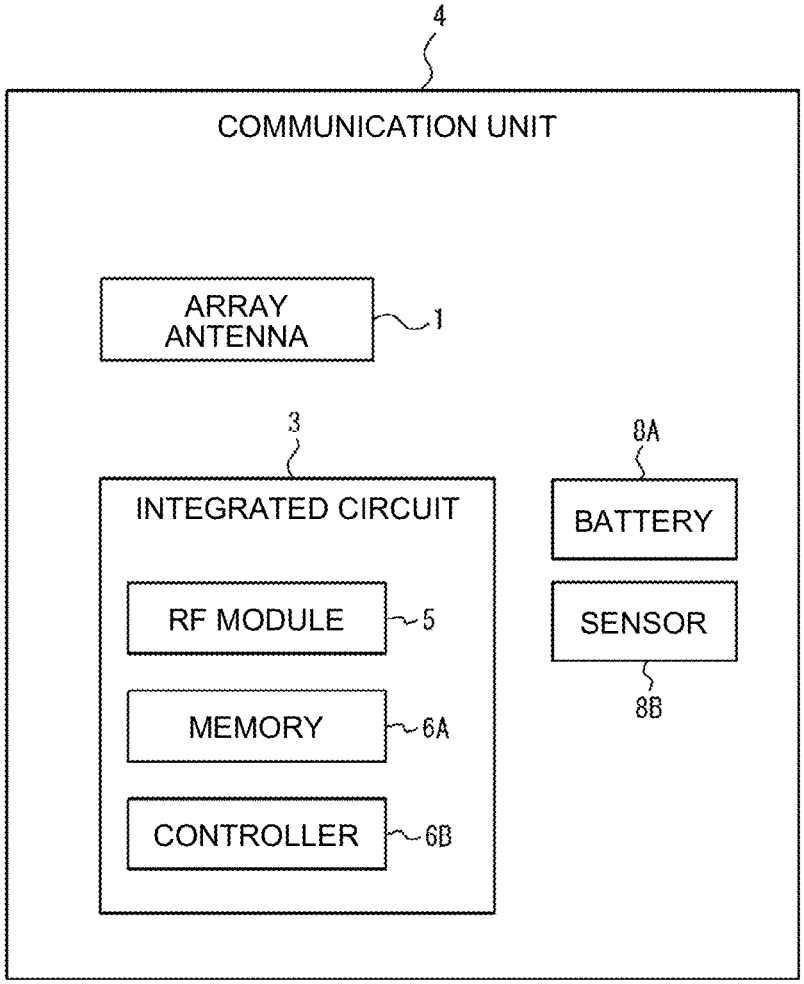
FIG. 18 is a block diagram of a communication unit according to an embodiment.
Figure 19:
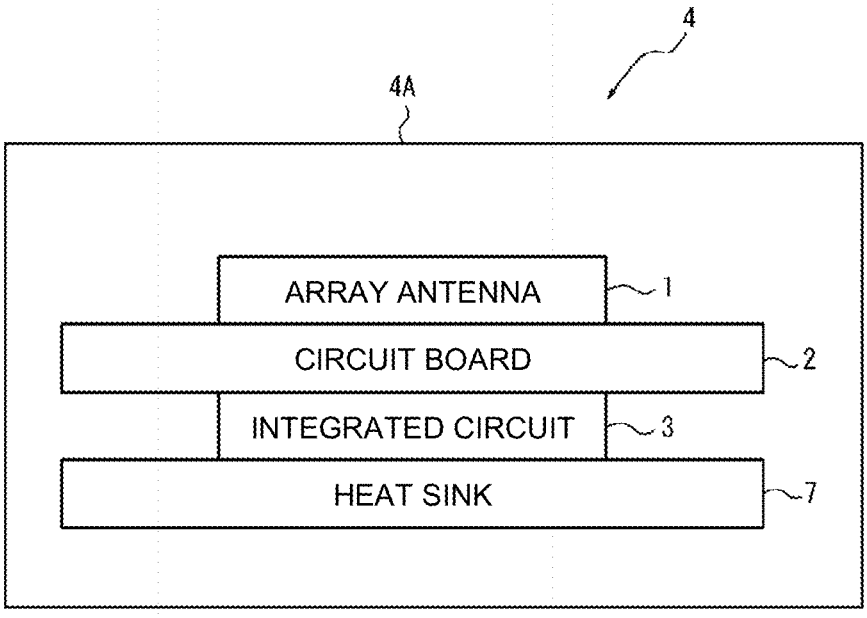
FIG. 19 is a cross-sectional view of the communication unit illustrated in FIG. 18.

FIG. 18 is a block diagram of a communication unit 4 according to an embodiment. FIG. 19 is a cross-sectional view of the communication unit 4 illustrated in FIG. 18.

As illustrated in FIG. 18, the communication unit 4 includes the array antenna 1, the integrated circuit 3, a battery 8A, and a sensor 8B as functional blocks. The communication unit 4 includes an RF module 5, a memory 6A, and a controller 6B as constituent elements of the integrated circuit 3. As illustrated in FIG. 19, the communication unit 4 includes the array antenna 1, the circuit board 2, and a heat sink 7 in a housing 4A. The integrated circuit 3, the battery 8A, and the sensor 8B may be mounted on the circuit board 2.

As illustrated in FIG. 18, the communication unit 4 includes the memory 6A and the controller 6B inside the integrated circuit 3. However, the communication unit 4 may include the memory 6A and the controller 6B outside the integrated circuit 3. The communication unit 4 may include any of the array antenna 1A illustrated in FIG. 1, the array antenna 1B illustrated in FIG. 12, the array antenna 1C illustrated in FIG. 14, and the array antenna 1D illustrated in FIG. 17 instead of the array antenna 1.

The RF module 5 may include a modulation circuit and a demodulation circuit. The RF module 5 may be configured to control electric power supplied to the array antenna 1 based on control by the controller 6B. The RF module 5 may be configured to modulate a baseband signal to be supplied to the array antenna 1 based on control by the controller 6B. The RF module 5 may be configured to modulate an electric signal received by the array antenna 1 into a baseband signal based on control by the controller 6B.

The memory 6A illustrated in FIG. 18 may include a semiconductor memory and the like, for example. The memory 6A may be configured to function as a work memory for the controller 6B. The memory 6A may be included in the controller 6B. The memory 6A stores therein a computer program in which processing contents for implementing respective functions of the communication unit 4 are written, information used for processing performed by the communication unit 4, and the like.

The controller 6B illustrated in FIG. 18 may include a processor, for example. The controller 6B may include one or more processors. The processors may include a general-purpose processor for implementing particular functions by reading particular programs, and a dedicated processor specialized in particular processing. The dedicated processor may include an application-specific IC. The application-specific IC is also referred to as an ASIC. The processor may include a programmable logic device. The programmable logic device is also referred to as a PLD. The PLD may include an FPGA. The controller 6B may be any of an SiP and an SoC in which one or a plurality of processors cooperate with each other. The controller 6B may store, in the memory 6A, various kinds of information or computer programs and the like for causing the constituent parts of the communication unit 4 to operate.

The controller 6B illustrated in FIG. 18 is configured to be connected to the filter 120 of the antenna element 100 via the RF module 5. The controller 6B is configured to cause the array antenna 1 to radiate, as electromagnetic waves, transmission signals that are electric signals by controlling the RF module 5. The controller 6B is configured to cause the array antenna 1 to acquire, as electric signals, reception signals that are electromagnetic waves by controlling the RF module 5.

For example, the controller 6B may be configured to generate transmission signals to be transmitted from the communication unit 4. The controller 6B may be configured to acquire measurement data from the sensor 8B. The controller 6B may be configured to generate transmission signals corresponding to the measurement data.

The heat sink 7 illustrated in FIG. 19 may include any heat conductive member. The heat sink 7 may be in contact with the integrated circuit 3. The heat sink 7 is configured to release heat generated from the integrated circuit 3 and the like to the outside of the communication unit 4.

The battery 8A is configured to supply electric power to the communication unit 4. The battery 8A may be configured to supply electric power to at least one of the memory 6A, the controller 6B, and the sensor 8B. The battery 8A may include at least one of a primary battery and a secondary battery. A negative electrode of the battery 8A is configured to be electrically connected to a ground terminal of the circuit board 2. The negative electrode of the battery 8A is configured to be electrically connected to the ground conductor 40 of the array antenna 1.

Examples of the sensor 8B include, but are not limited to, a velocity sensor, a vibration sensor, an acceleration sensor, a gyro sensor, a rotation angle sensor, an angular velocity sensor, a geomagnetic sensor, a magnet sensor, a temperature sensor, a humidity sensor, an atmospheric pressure sensor, an optical sensor, an illuminance sensor, a UV sensor, a gas sensor, a gas concentration sensor, an atmosphere sensor, a level sensor, an odor sensor, a pressure sensor, an air pressure sensor, a contact sensor, a wind force sensor, an infrared sensor, a human sensor, a displacement amount sensor, an image sensor, a weight sensor, a smoke sensor, a liquid leakage sensor, a vital sensor, a battery charge sensor, an ultrasonic sensor, a Global Positioning System (GPS) signal receiving device, etc.

Figure 20:
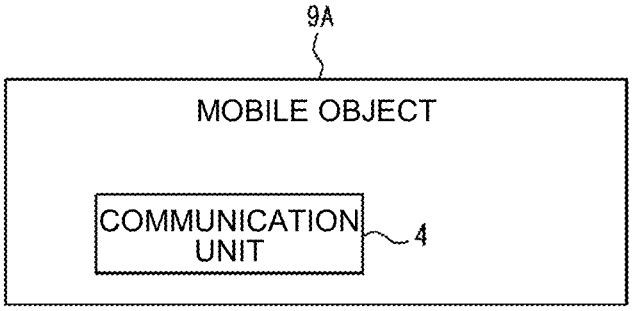
FIG. 20 is a block diagram of a mobile body according to an embodiment.

FIG. 20 is a block diagram of a mobile body 9A according to an embodiment.

Examples of the "mobile body" in the present disclosure may include, but are not limited to, a vehicle, a ship, an aircraft, etc. Examples of the vehicle may include, but are not limited to, an automobile, an industrial vehicle, a railway vehicle, a household vehicle, a fixed-wing aircraft running on a runway, etc. Examples of the automobile may include, but are not limited to, an automobile, a truck, a bus, a two-wheeled vehicle, a trolley bus, etc. Examples of the industrial vehicle may include, but are not limited to, an industrial vehicle for agriculture or construction industry, etc. Examples of the industrial vehicle may include, but are not limited to, a forklift, a golf cart, etc. Examples of the industrial vehicle for agriculture may include, but are not limited to, a tractor, a cultivator, a transplanter, a binder, a combine, a lawn mower, etc. Examples of the industrial vehicle for construction industry may include, but are not limited to, a bulldozer, a scraper, a power shovel, a crane truck, a dump truck, a road roller, etc. Examples of the vehicle may include, but are not limited to, a vehicle that runs by human power, etc. Classifications of the vehicle are not limited to the examples described above. Examples of the automobile may include, but are not limited to, an industrial vehicle capable of running on a road. A plurality of classifications may include the same vehicle. Examples of the ship may include, but are not limited to, a marine jet, a boat, a tanker, etc. Examples of the aircraft may include, but are not limited to, a fixed-wing aircraft, a rotary-wing aircraft, etc.

The mobile body 9A includes the communication unit 4. The mobile body 9A may also include any constituent element in addition to the communication unit 4 to exhibit a desired function of the mobile body 9A, for example. For example, in a case in which the mobile body 9A is an automobile, the mobile body 9A may include an engine, a brake, a steering gear, and the like.

Figure 21:
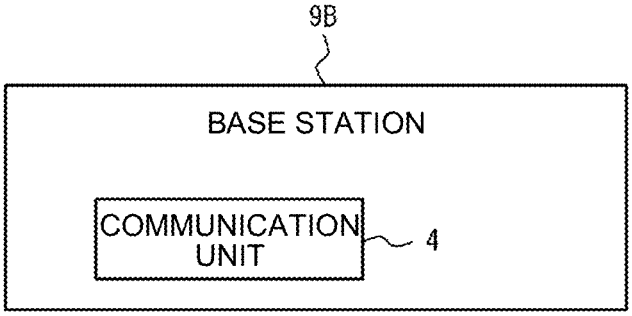
FIG. 21 is a block diagram of a base station according to an embodiment.

FIG. 21 is a block diagram of a base station 9B according to an embodiment.

The "base station" in the present disclosure indicates a fixed base capable of communicating with the mobile body 9A in a wireless manner. The "base station" in the present disclosure may include wireless facilities managed by a telecommunications carrier, a radio operator, and the like.

The base station 9B includes the communication unit 4. The base station 9B may include at least the array antenna 1 and the controller 6B connected to the array antenna 1 among the constituent elements of the communication unit 4 illustrated in FIG. 18. The base station 9B may also include any constituent element in addition to the communication unit 4 to exhibit a desired function of the base station 9B, for example.

The configuration according to the present disclosure is not limited to some embodiments described above, and can be variously modified or changed. For example, the function and the like included in the respective constituent parts and the like can be rearranged without causing logical contradiction, and a plurality of constituent parts and the like can be combined into one constituent part, or can be divided.

Figure 22:
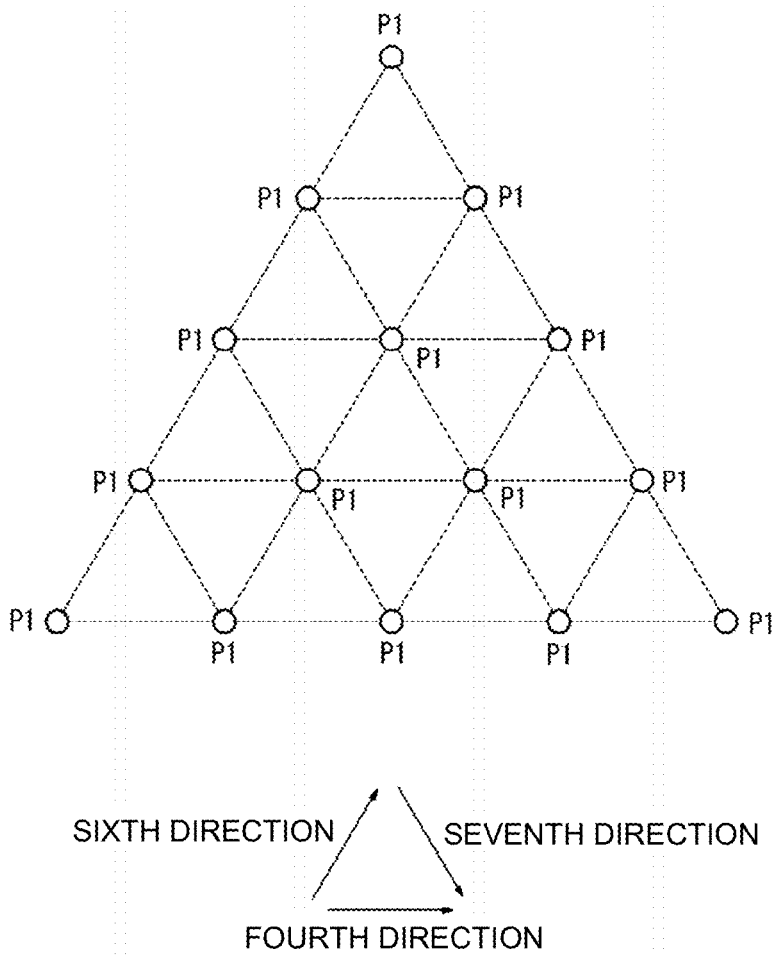
FIG. 22 is a diagram illustrating another example of arrangement of the antenna elements.

For example, the antenna elements 100 illustrated in FIG. 5 may be arranged in a triangular lattice shape on the array antenna 1A. FIG. 22 illustrates an example in which the antenna elements 100 are arranged in a triangular lattice shape. A position P1 illustrated in FIG. 22 indicates a position of the antenna element 100. A sixth direction illustrated in FIG. 22 is a direction forming an angle smaller than 90 degrees with the fourth direction. A seventh direction is a direction intersecting with the fourth direction and the sixth direction. In the same way or similarly, the antenna elements 100A illustrated in FIG. 10, the antenna elements 100B illustrated in FIG. 12, the antenna elements 100C illustrated in FIG. 14, and the antenna elements 100D illustrated in FIG. 17 may be arranged in a triangular lattice shape.

The diagrams for explaining the configurations according to the present disclosure are schematically illustrated. A dimension ratio and the like in the drawings are not necessarily identical to an actual dimension ratio and the like.

In the present disclosure, the terms "first", "second", "third" and so on are examples of identifiers meant to distinguish the configurations from each other. In the present disclosure, regarding the configurations distinguished by the terms "first" and "second", the respective identifying numbers can be reciprocally replaced with each other. For example, regarding the first frequency and the second frequency, the identifiers "first" and "second" can be reciprocally exchanged. The exchange of identifiers is performed simultaneously. Even after exchanging the identifies, the configurations remain distinguished from each other. Identifiers may be removed. The configurations from which the identifiers are removed are still distinguishable by the reference numerals. In the present disclosure, the terms "first", "second", and so on of the identifiers should not be used in the interpretation of the order of the configurations, or should not be used as the basis for having identifiers with low numbers, or should not be used as the basis for having identifiers with high numbers.

The invention claimed is:

1. An antenna element, comprising:
an antenna; and
a filter, wherein
the antenna comprises:
a conductor part that extends along a first plane and includes a plurality of first conductors;
a ground conductor that is positioned separately from the conductor part and extends along the first plane;
a first predetermined number of connection conductors that extend from the ground conductor toward the conductor part, the first predetermined number being three or more;
a first feeding line that is electromagnetically connected to the conductor part; and
a second feeding line configured to be electromagnetically connected to the conductor part at a position different from a position of the first feeding line,
the filter is configured to be electrically connected to at least one of the first feeding line and the second feeding line, and
the filter is positioned to be overlapped with the ground conductor.

2. The antenna element according to claim 1, wherein
at least two of the first conductors are configured to be connected to the connection conductors different from each other,
the first predetermined number of connection conductors include:
a first connection pair including any two of the connection conductors arranged along a first direction included in the first plane; and
a second connection pair including any two of the connection conductors arranged along a second direction that is included in the first plane and intersects with the first direction, and
the antenna element is configured to
resonate at a first frequency along a first current path including the ground conductor, the conductor part, and the first connection pair, and
resonate at a second frequency along a second current path including the ground conductor, the conductor part, and the second connection pair.

3. An array antenna, comprising:
a plurality of the antenna elements according to claim 1; and
an antenna substrate on which the antenna elements are arranged.

4. The array antenna according to claim 3, wherein the antenna elements are integrated with the antenna substrate.

5. The array antenna according to claim 3, wherein
the antenna substrate comprises a plurality of substrate parts, and
at least one of the antenna elements is arranged on the substrate part.

6. The array antenna according to claim 3, wherein the antenna elements are arranged along a fourth direction.

7. The array antenna according to claim 3, wherein
the antenna elements include:
a first antenna element including a first antenna and a first filter; and
a second antenna element including a second antenna and a second filter,
the first filter is configured to be electrically connected to a first feeding line of the first antenna and a first feeding line of the second antenna, and
the second filter is configured to be electrically connected to a second feeding line of the first antenna and a second feeding line of the second antenna.

8. The array antenna according to claim 3, wherein
the filter is configured to be electrically connected to the first feeding line and the second feeding line of the antenna.

9. The array antenna according to claim 3, wherein the antenna elements are arranged in a lattice shape along the fourth direction and a fifth direction intersecting with the fourth direction.

10. The array antenna according to claim 3, wherein the antenna elements are arranged in a lattice shape along the fourth direction, a sixth direction forming an angle smaller than 90 degrees with the fourth direction, and a seventh direction intersecting with the fourth direction and the sixth direction.

11. The array antenna according to claim 9, wherein the fourth direction is a direction along the first direction or the second direction.

12. A communication unit, comprising:
the array antenna according to claim 3; and
a controller configured to be connected to the filter.

13. A mobile body, comprising:
the communication unit according to claim 12.

14. A base station, comprising:
the array antenna according to claim 3; and
a controller configured to be connected to the filter.

15. The array antenna according to claim 10, wherein the fourth direction is a direction along the first direction or the second direction.

* * * * *